US009296976B2

(12) United States Patent
Matsumoto et al.

(10) Patent No.: US 9,296,976 B2
(45) Date of Patent: Mar. 29, 2016

(54) LUBRICATING OIL COMPOSITION

(75) Inventors: Tomonari Matsumoto, Tokyo (JP); Fumiyuki Nara, Tokyo (JP); Takeshi Okido, Tokyo (JP); Katsuya Takigawa, Tokyo (JP)

(73) Assignee: JX NIPPON OIL & ENERGY CORPORATION, Tokyo (JP)

( * ) Notice: Subject to any disclaimer, the term of this patent is extended or adjusted under 35 U.S.C. 154(b) by 211 days.

(21) Appl. No.: 13/521,880

(22) PCT Filed: Dec. 10, 2010

(86) PCT No.: PCT/JP2010/072265

§ 371 (c)(1),
(2), (4) Date: Aug. 27, 2012

(87) PCT Pub. No.: WO2011/086800

PCT Pub. Date: Jul. 21, 2011

(65) Prior Publication Data

US 2012/0322706 A1 Dec. 20, 2012

(30) Foreign Application Priority Data

Jan. 18, 2010 (JP) ..... P2010-008353
Dec. 2, 2010 (JP) ..... P2010-269511

(51) Int. Cl.

*C10M 169/04* (2006.01)
*C10M 141/10* (2006.01)
*C10M 129/54* (2006.01)
*C10M 171/00* (2006.01)

(52) U.S. Cl.

CPC ..... *C10M 171/008* (2013.01); *C10M 141/10* (2013.01); *C10M 169/04* (2013.01); *C10M 2207/026* (2013.01); *C10M 2207/042* (2013.01); *C10M 2207/0406* (2013.01); *C10M 2207/2805* (2013.01); *C10M 2207/289* (2013.01); *C10M 2207/2835* (2013.01); *C10M 2207/401* (2013.01); *C10M 2209/04* (2013.01); *C10M 2209/043* (2013.01); *C10M 2209/103* (2013.01); *C10M 2209/1055* (2013.01); *C10M 2223/041* (2013.01); *C10M 2223/043* (2013.01); *C10M 2223/047* (2013.01); *C10N 2220/021* (2013.01); *C10N 2220/022* (2013.01); *C10N 2220/023* (2013.01); *C10N 2230/06* (2013.01); *C10N 2230/12* (2013.01); *C10N 2230/54* (2013.01); *C10N 2230/64* (2013.01); *C10N 2240/08* (2013.01); *C10N 2240/10* (2013.01); *C10N 2240/30* (2013.01)

(58) Field of Classification Search

CPC ..... C10M 171/008; C10M 169/04; C10M 141/10; C10M 2207/026; C10M 2207/0406; C10M 2207/042; C10M 2207/2805; C10M 2207/2835; C10M 2207/289; C10M 2207/401; C10M 2209/04; C10M 2209/043; C10M 2209/103; C10M 2209/1055; C10M 2223/041; C10M 2223/043; C10M 2223/047; C10N 2220/021; C10N 2220/022; C10N 2220/023; C10N 2230/06; C10N 2230/12; C10N 2230/54; C10N 2230/64; C10N 2240/08; C10N 2240/10; C10N 2240/30

USPC ..... 508/440, 502, 437

See application file for complete search history.

(56) References Cited

U.S. PATENT DOCUMENTS

| | | | | |
|---|---|---|---|---|
| 3,790,478 | A | 2/1974 | Rudston et al. | |
| 3,914,179 | A * | 10/1975 | Byford et al. | 508/282 |
| 4,877,541 | A * | 10/1989 | Wisotsky et al. | 508/502 |
| 7,018,558 | B2 * | 3/2006 | Schnur et al. | 252/68 |
| 7,517,838 | B2 | 4/2009 | Kawahara et al. | |
| 2006/0019840 | A1 * | 1/2006 | Kawahara et al. | 508/280 |
| 2011/0207638 | A1 | 8/2011 | Singh et al. | |
| 2011/0275549 | A1 | 11/2011 | Nonaka et al. | |

FOREIGN PATENT DOCUMENTS

| | | |
|---|---|---|
| CN | 1678721 | 10/2005 |
| GB | 1180389 | 2/1970 |
| JP | 9-504824 | 5/1997 |
| JP | 11-209779 | 8/1999 |
| JP | 2003-119482 | 4/2003 |
| JP | 2004-510032 | 4/2004 |
| JP | 2006-169402 | 6/2006 |
| WO | 2004/018595 | 3/2004 |
| WO | 2009/116082 | 9/2009 |
| WO | 2010/079744 | 7/2010 |

OTHER PUBLICATIONS

International Search Report for PCT/JP2010/072265, mailed Jan. 11, 2011.

English-language translation of International Preliminary Report on Patentability issued with respect to PCT/JP2010/072265, mailed Aug. 16, 2012.

Search Report with respect to counterpart European Appl. No. 10843155.2, dated Jul. 17, 2013.

Office Action issued for Japanese Patent Application No. 2010-269511 mailed Nov. 18, 2014.

Chinese Office action for CN Patent Application No. 201080061807.6, mailed May 29, 2013.

* cited by examiner

*Primary Examiner* — James Goloboy

(74) *Attorney, Agent, or Firm* — Greenblum & Bernstein, P.L.C.

(57) ABSTRACT

The lubricating oil composition of the invention comprises a lubricant base oil, a 3,4,5-trihydroxybenzoic acid ester at 5-5000 ppm by mass, and a phosphorus compound at 0.001-10.0% by mass, based on the total mass of the lubricating oil composition. The lubricating oil composition of the invention significantly lowers wear and exhibits a stable low frictional coefficient, while having a high rust-preventing effect for iron-based sliding sections. The lubricating oil composition of the invention is therefore suitable for prolonged use, and exhibits a notable effect for energy savings as well due to its stable low frictional coefficient property.

9 Claims, No Drawings

LUBRICATING OIL COMPOSITION

TECHNICAL FIELD

The present invention relates to a lubricating oil composition with excellent lubricity, which is especially useful when using polar oxygen-containing compounds such as animal or vegetable oils, esters or ethers as base oils.

BACKGROUND ART

Environmental considerations have become important in a variety of fields in recent years. Reduction in carbon dioxide, in particular, has become an urgent issue, and efforts are being made to increase energy efficiency in domestic industrial fields and in transportation fields, including automobiles, as well as in styles of consumption in general.

For example, in systems of industrial machinery that require large work energy, such as injection molding machines, machine tools and press working machines, there are often employed hydraulic systems capable of converting the pressure energy of hydraulic pumps to kinetic energy. The need for energy savings is also high in such hydraulic systems, and energy-efficiency countermeasures are being sought for hydraulic oils used as hydraulic system pressure media, with the aim of achieving lower viscosity and a higher viscosity index, but reduced viscosity has led to problems such as reduced abrasion resistance and seizing at sliding parts.

Recently, loads on sliding sections have been increasing due to trends toward smaller sizes, higher speeds and greater fuel efficiency and energy savings in mechanical systems, creating a demand for lubricant oils with more excellent lubricity, including wear resistance. The use of oxygen-containing synthetic oils such as esters and ethers has been increasing to meet this demand.

From the viewpoint of environmental pollution, on the other hand, biodegradable lubricant oils such as animal or vegetable oils or esters with specific structures are being increasingly employed as environmentally friendly base materials. It is therefore expected that lubricant oils with oxygen-containing compounds as base oils, exhibiting characteristics not found in hydrocarbon oils such as mineral oils, will become even more prevalent in the future.

The ideal characteristics for a lubricant oil are low frictional loss and low wear such as fretting wear, both at high speeds and at low speeds. That is, a lubricant oil is desired to have low frictional loss and reduced wear. It is therefore desirable to have low frictional loss and minimal wear both during periods of high contact surface speeds such as during high-speed rotation, and during periods of high torque at low speeds.

In the case of polar oxygen-containing compound-based lubricant oils, however, wear-resistance agents used in common hydrocarbon-based lubricant oils such as mineral oils have affinity with polar base oils, and therefore the concentration of the wear-resistance agent at sliding sections is low resulting in a poor lubricity-improving effect, such that further development of effective wear-resistance agents in oxygen-containing compound-based lubricant oils such as esters is desired.

Polyol ester- and ether-based oxygen-containing compounds that exhibit compatibility with hydrofluorocarbon refrigerants are used as base oils in the field of refrigerating machine oils, and it has been proposed to add 3,4,5-trihydroxybenzoic acid esters to such base oils, in order to inhibit elution of lead in refrigerating air conditioners that comprise lead-containing bearings (Patent document 1).

CITATION LIST

Patent Literature

[Patent document 1] Japanese Unexamined Patent Application Publication No. 2006-169402

SUMMARY OF INVENTION

Technical Problem

It is an object of the present invention to provide a lubricating oil composition that solves the problems associated with sliding sections, that are becoming more severe due to downsizing, increasing speeds, fuel efficiency and energy savings, exhibiting vastly reduced wear and a stable low frictional coefficient, and having high rust resistance for lubrication of iron-based sliding sections.

Solution to Problem

The present inventors have pursued diligent research toward development of an oxygen-containing compound-based lubricant oil having low frictional loss and minimal wear including fretting wear, both at high speeds and low speeds. As a result, it was surprisingly found that when a combination of a 3,4,5-trihydroxybenzoic acid ester and a phosphoric acid ester is used:

(i) the frictional coefficient is lowered and a function is exhibited that can inhibit wear, (ii) hematite, which is iron red rust, is reduced to hard, strong black rust (magnetite), thereby producing a high rust-preventing effect, and (iii) the 3,4,5-trihydroxybenzoic acid ester sufficiently dissolves in oxygen-containing compound-based oils such as animal or vegetable oils and esters, so that its effect is adequately exhibited in combination with the phosphoric acid ester, and the invention was thereupon devised.

Specifically, the present invention provides the following.

(1) A lubricating oil composition comprising a lubricant base oil, a 3,4,5-trihydroxybenzoic acid ester at 5-5000 ppm by mass, and a phosphorus compound at 0.001-10.0% by mass, based on the total mass of the lubricating oil composition.

(2) A lubricating oil composition according to (1), wherein the 3,4,5-trihydroxybenzoic acid ester is ethyl 3,4,5-trihydroxybenzoate or propyl 3,4,5-trihydroxybenzoate.

(3) A lubricating oil composition according to (1) or (2), wherein the phosphorus compound is at least one compound selected from among triphenyl phosphate and tricresyl phosphate.

(4) A lubricating oil composition according to any one of (1) to (3), wherein the lubricant base oil is at least one compound selected from among animal or vegetable oils, esters and ethers, and the 40° C. kinematic viscosity of the lubricant base oil is 2-1000 $mm^2/s$.

(5) A lubricating oil composition according to any one of (1) to (4), which is used for lubrication of an iron-based sliding section.

(6) A lubricating oil composition according to any one of (1) to (5), having a biodegradation of 60% or greater.

(7) A refrigerating machine oil comprising a lubricating oil composition according to any one of (1) to (6).

Advantageous Effects of Invention

The lubricating oil composition of the invention significantly lowers wear, exhibits a stable low frictional coefficient, while having a high rust-preventing effect for iron-based sliding sections. The lubricating oil composition of the invention is therefore suitable for prolonged use, and exhibits a notable effect for energy savings as well, due to its stable low frictional coefficient property.

DESCRIPTION OF EMBODIMENTS

The lubricating oil composition of this embodiment comprises a lubricant base oil, a 3,4,5-trihydroxybenzoic acid ester at 5-5000 ppm by mass, and a phosphorus compound at 0.001-10.0% by mass, based on the total mass of the lubricating oil composition.

Incidentally, 3,4,5-trihydroxybenzoic acid esters have low solubility in hydrocarbon-based base oils such as mineral oil-based base oils, and therefore, by themselves, cannot be added at concentrations that allow improved lubricity to be exhibited; however, using a polar oxygen-containing compound as the base oil allows their use at concentrations that improve lubricity. In particular, C2 and C3 alkyl esters of 3,4,5-trihydroxybenzoic acid, which have a suitable balance of solubility and lubricity-improving effect, exhibit exceptional lubricity-improving effects in combination with phosphoric acid esters.

[Lubricant Base Oil]

According to the invention it is possible to use an oxygen-containing compound, such as an animal or vegetable oil or synthetic oil compound, as the lubricant base oil. Two or more of such lubricant base oils may also be used in admixture.

The physical properties of the lubricant base oil used for the invention are not particularly restricted, but it has a 40° C. kinematic viscosity of preferably 2-1000 $mm^2/s$, and for energy savings through viscosity reduction, more preferably 5-500 $mm^2/s$ and even more preferably 5-100 $mm^2/s$. However, a high-viscosity base oil is preferably used for applications with high loads.

The viscosity index is preferably 50 or greater, and more preferably 100-250. The pour point, as a low-temperature characteristic, is preferably no higher than −10° C. and more preferably no higher than −15° C. Also, from a safety viewpoint, the flash point is preferably 70° C. or higher and more preferably 150° C. or higher.

Suitable animal or vegetable oil-based lubricant base oils to be used include milk fat, beef tallow, lard, tallow, hoof oil, whale oil, salmon oil, bonito oil, herring oil, codfish oil, soybean oil, rapeseed oil, sunflower oil, safflower oil, peanut oil, corn oil, cottonseed oil, rice bran oil, kapok oil, sesame oil, olive oil, linseed oil, castor oil, cocoa butter, shea butter, palm oil, palm kernel oil, coconut oil, hempseed oil, rice oil and tea seed oil, with no particular limitation to these.

Synthetic oil-based lubricant base oils include esters, ethers, glycols and the like. Esters and ethers are more preferably used.

Compounds with various molecular structures are commercially available as esters, each having unique properties, and they have higher flash points compared to hydrocarbon-based base oils with similar viscosities. Although esters can be obtained by dehydrating condensation polymerization reaction between alcohols and fatty acids, according to the invention, a diester of a dibasic acid and a monohydric alcohol or a polyol ester of a polyol and a monovalent fatty acid is preferably used as the base oil component, from the standpoint of chemical stability.

Preferred as ethers are compounds represented by the following formula (I).

$$X[—O-(AO)_n—R^1]_m \quad (I)$$

Formula (I) represents a compound wherein X is a hydrocarbon in the form of a hydroxyl group-removed mono-ol or polyol, A is a C2-4 alkylene, $R^1$ is hydrogen or a C1-10 alkyl, m is the valency of X, and n is an integer of 2 or greater.

Preferred as glycols are polyoxyalkyleneglycol compounds represented by the following formula (II).

$$R^2—[(OR^3)_f—OR^4]_g \quad (II)$$

Formula (II) represents a compound wherein $R^2$ represents hydrogen, C1-10 alkyl, C2-10 acyl, or a residue of a compound having 2-8 hydroxyl groups, $R^3$ represents C2-4 alkylene, $R^4$ represents hydrogen, C1-10 alkyl or C2-10 acyl, f is an integer of 1-80, and g is an integer of 1-8.

Normally, these synthetic oil-based and animal or vegetable oil-based lubricant base oils may be combined as appropriate, and in suitable proportions to provide the performance required for different purposes. Multiple synthetic oil-based and animal or vegetable oil-based lubricant base oils may also be used.

The base oil used for the invention may be a mineral oil or synthetic oil, or it may be a mixed base oil comprising a mineral oil and a synthetic oil. Examples of mineral oils include paraffinic mineral oils or naphthenic mineral oils obtained by applying an appropriate combination of one or more refining means such as solvent deasphalting, solvent extraction, hydrotreatment, solvent dewaxing, catalytic dewaxing, hydrorefining, sulfuric acid washing or white clay treatment, on a lube-oil distillate obtained from atmospheric distillation and vacuum distillation of paraffinic crude oil, intermediate base crude oil or naphthenic crude oil.

Of these mineral oils, it is preferred to use mineral oils that have been highly refined (hereunder referred to as "highly-refined mineral oils"), from the viewpoint of excellent thermostability. Specific examples of highly-refined mineral oils include refined oils obtained by common refining of distilled oils obtained by atmospheric distillation of paraffinic crude oils, intermediate base crude oils or naphthenic crude oils, or by vacuum distillation of the residue oils of atmospheric distillation; deep dewaxing oils obtained by further deep dewaxing treatment following refining; and hydrotreated oils obtained by hydrotreatment.

There are no particular restrictions on the refining method in the refining step, and a conventionally known method may be employed, such as (a) hydrotreatment, (b) dewaxing treatment (solvent dewaxing or hydrodewaxing), (c) solvent extraction, (d) alkaline cleaning or sulfuric acid cleaning or (e) white clay treatment, either alone, or 2 or more thereof in combination in an appropriate order. It is also effective to carry out any of the treatments (a) to (e) in a repetitive manner, divided into multiple stages. More specifically, this may be (i) a method of hydrotreatment of distilled oil, or hydrotreatment followed by alkaline cleaning or sulfuric acid cleaning; (ii) a method of hydrotreatment of a distilled oil, followed by dewaxing treatment; (iii) a method of solvent extraction of a distilled oil, followed by hydrotreatment; (iv) a method of two or three stages of hydrotreatment of a distilled oil, optionally followed by alkaline cleaning or sulfuric acid cleaning; or (v)

a method of any of the above-mentioned treatments (i) to (iv), followed by further dewaxing treatment to obtain a deep dewaxing oil.

Of the highly-refined mineral oils obtained by such refining processes, naphthenic mineral oils and mineral oils obtained by deep dewaxing treatment are preferred from the viewpoint of low-temperature flow properties and avoiding wax deposition at low temperature. The deep dewaxing treatment may usually be carried out by solvent dewaxing treatment under harsh conditions, or by catalytic dewaxing treatment using a zeolite catalyst.

The non-aromatic unsaturated portion (degree of unsaturation) of the highly-refined mineral oil is preferably no greater than 10% by mass, more preferably no greater than 5% by mass, even more preferably no greater than 1% by mass and most preferably no greater than 0.1% by mass. If the non-aromatic unsaturated portion is greater than 10% by mass, sludge will tend to be generated, often resulting in more obstruction of the expansion mechanisms such as capillaries composing the refrigerant circulation system.

On the other hand, a synthetic oil used for the invention may be a hydrocarbon-based oil such as an olefin polymer, naphthalene compound or alkylbenzene; or an oxygen-containing synthetic oil such as an ester, polyalkylene glycol, polyvinyl ether, ketone, polyphenyl ether, silicone, polysiloxane or perfluoroether.

Olefin polymers as hydrocarbon-based oils include those obtained by polymerization of C2-12 olefins, and hydrotreated forms of those compounds obtained by polymerization, and there are preferably used polybutene, polyisobutene, C5-12 α-olefin oligomers (poly α-olefins), ethylene-propylene copolymers and their hydrotreated forms.

There are no particular restrictions on the method for producing an olefin polymer, and it may be produced by any of various methods. For example, a poly α-olefin is produced using an α-olefin produced from ethylene as starting material, and treating it by a known polymerization method such as a Ziegler catalyst method, radical polymerization method, aluminum chloride method or boron fluoride method.

There are no particular restrictions on naphthalene compounds as hydrocarbon-based oils, so long as they have a naphthalene skeleton, but from the viewpoint of excellent compatibility with refrigerants, they preferably have 1-4 C1-10 alkyl groups, with a total of 1-10 carbon atoms in the alkyl groups, and more preferably they have 1-3 C1-8 alkyl groups, with a total of 3-8 carbon atoms in the alkyl groups.

The C1-10 alkyl groups of a naphthalene compound may be, specifically, methyl, ethyl, n-propyl, isopropyl, straight-chain or branched butyl, straight-chain or branched pentyl, straight-chain or branched hexyl, straight-chain or branched heptyl, straight-chain or branched octyl, straight-chain or branched nonyl, straight-chain or branched decyl, and the like.

When a naphthalene compound is used, it may be used alone as a compound with a single structure, or 2 or more compounds with different structures may be used in combination.

Also, there are no particular restrictions on the method for producing the naphthalene compound, and it may be produced by any of various known methods. Examples thereof include methods of adding halogenated C1-10 hydrocarbons, C2-10 olefins or C8-10 styrenes to naphthalene in the presence of acid catalysts including mineral acids such as sulfuric acid, phosphoric acid, silicotungstic acid or hydrofluoric acid, solid acidic substances such as acidic white clay or active white clay, or Friedel-Crafts catalysts which are metal halides such as aluminum chloride or zinc chloride.

There are no particular restrictions on alkylbenzenes as hydrocarbon-based oils, but from the viewpoint of excellent compatibility with refrigerants, they preferably have 1-4 C1-40 alkyl groups, with a total of 1-40 carbon atoms in the alkyl groups, and more preferably they have 1-4 C1-30 alkyl groups, with a total of 3-30 carbon atoms in the alkyl groups.

Specific C1-40 alkyl groups in alkylbenzenes include methyl, ethyl, n-propyl, isopropyl, straight-chain or branched butyl, straight-chain or branched pentyl, straight-chain or branched hexyl, straight-chain or branched heptyl, straight-chain or branched octyl, straight-chain or branched nonyl, straight-chain or branched decyl, straight-chain or branched undecyl, straight-chain or branched dodecyl, straight-chain or branched tridecyl, straight-chain or branched tetradecyl, straight-chain or branched pentadecyl, straight-chain or branched hexadecyl, straight-chain or branched heptadecyl, straight-chain or branched octadecyl, straight-chain or branched nonadecyl, straight-chain or branched eicosyl, straight-chain or branched heneicosyl, straight-chain or branched docosyl, straight-chain or branched tricosyl, straight-chain or branched tetracosyl, straight-chain or branched pentacosyl, straight-chain or branched hexacosyl, straight-chain or branched heptacosyl, straight-chain or branched octacosyl, straight-chain or branched nonacosyl, straight-chain or branched triacontyl, straight-chain or branched hentriacontyl, straight-chain or branched dotriacontyl, straight-chain or branched tritriacontyl, straight-chain or branched tetratriacontyl, straight-chain or branched pentatriacontyl, straight-chain or branched hexatriacontyl, straight-chain or branched heptatriacontyl, straight-chain or branched octatriacontyl, straight-chain or branched nonatriacontyl and straight-chain or branched tetracontyl (including all isomers).

These alkyl groups may be straight-chain or branched, but are preferably straight-chain alkyl groups from the viewpoint of compatibility with organic materials to be used in refrigerant circulation systems. From the viewpoint of refrigerant compatibility, thermostability and lubricity, on the other hand, they are preferably branched alkyl groups, and from the viewpoint of availability, they are more preferably branched alkyl groups derived from olefin oligomers such as propylene, butene and isobutylene.

When an alkylbenzene compound is used, it may be used alone as a compound with a single structure, or 2 or more compounds with different structures may be used in combination.

The method for producing the alkylbenzene may be any desired one without any restrictions, and it may be produced by the following synthesis method, for example.

Specifically, benzene, toluene, xylene, ethylbenzene, methylethylbenzene, diethylbenzene and mixtures thereof may be used as aromatic compounds for the starting material. As alkylating agents there may be used C6-40 straight-chain or branched olefins obtained by polymerization of lower monoolefins such as ethylene, propylene, butene or isobutylene (preferably propylene); C6-40 straight-chain or branched olefins obtained by thermal decomposition of waxes, heavy oils, petroleum fractions, polyethylene, polypropylene or the like; and C9-40 straight-chain olefins obtained by separating n-paraffins from petroleum fractions such as kerosene or light oil, and subjecting them to olefination with a catalyst, as well as mixtures of the foregoing.

When such an aromatic compound and an alkylating agent are to be reacted, there may be used a conventionally known alkylating catalyst, for example, a Friedel-Crafts catalyst such as aluminum chloride or zinc chloride or an acidic catalyst such as sulfuric acid, phosphoric acid, silicotungstic acid, hydrofluoric acid or active white clay.

Examples of esters as oxygen-containing synthetic oils include aromatic esters, dibasic acid esters, polyol esters, complex esters and carbonic acid esters, as well as mixtures of the foregoing.

Such aromatic esters include esters of monovalent to hexavalent, preferably monovalent to tetravalent and more preferably monovalent to trivalent aromatic carboxylic acids with C1-18 and preferably C1-12 aliphatic alcohols. Specific examples of monovalent to hexavalent aromatic carboxylic acids include benzoic acid, phthalic acid, isophthalic acid, terephthalic acid, trimellitic acid and pyromellitic acid, as well as mixtures of the foregoing. The C1-18 aliphatic alcohols may be straight-chain or branched, and specifically they include methanol, ethanol, straight-chain or branched propanol, straight-chain or branched butanol, straight-chain or branched pentanol, straight-chain or branched hexanol, straight-chain or branched heptanol, straight-chain or branched octanol, straight-chain or branched nonanol, straight-chain or branched decanol, straight-chain or branched undecanol, straight-chain or branched dodecanol, straight-chain or branched tridecanol, straight-chain or branched tetradecanol, straight-chain or branched pentadecanol, straight-chain or branched hexadecanol, straight-chain or branched heptadecanol and straight-chain or branched octadecanol, as well as mixtures of the foregoing.

Specific examples of aromatic esters obtained using aromatic compounds and aliphatic alcohols include dibutyl phthalate, di(2-ethylhexyl)phthalate, dinonyl phthalate, didecyl phthalate, didodecyl phthalate, ditridecyl phthalate, tributyl trimellitate, tri(2-ethylhexyl)trimellitate, trinonyl trimellitate, tridecyl trimellitate, tridodecyl trimellitate and tritridecyl trimellitate. Naturally, when a dibasic or greater aromatic carboxylic acid has been used, the ester may be a simple ester comprising a single aliphatic alcohol, or a complex ester comprising 2 or more different aliphatic alcohols.

Dibasic acid esters preferred for use include esters of C5-10 straight-chain or cyclic aliphatic dibasic acids such as glutaric acid, adipic acid, pimelic acid, suberic acid, azelaic acid, sebacic acid, 1,2-cyclohexanedicarboxylic acid and 4-cyclohexene-1,2-dicarboxylic acid, and straight-chain or branched C1-15 monohydric alcohols such as methanol, ethanol, propanol, butanol, pentanol, hexanol, heptanol, octanol, nonanol, decanol, undecanol, dodecanol, tridecanol, tetradecanol and pentadecanol, as well as mixtures of the foregoing. More specifically, they include diesters of ditridecyl glutarate, di-2-ethylhexyl adipate, diisodecyl adipate, ditridecyl adipate, di-2-ethylhexyl sebacate and 1,2-cyclohexanedicarboxylic acid with C4-9 monohydric alcohols, and diesters of 4-cyclohexene-1,2-dicarboxylic acid with C4-9 monohydric alcohols, as well as mixtures of the foregoing.

As polyol esters there may be used esters of diols or polyols with 3-20 hydroxyl groups, with C6-20 fatty acids. Specific examples of diols include ethylene glycol, 1,3-propanediol, propylene glycol, 1,4-butanediol, 1,2-butanediol, 2-methyl-1,3-propanediol, 1,5-pentanediol, neopentyl glycol, 1,6-hexanediol, 2-ethyl-2-methyl-1,3-propanediol, 1,7-heptanediol, 2-methyl-2-propyl-1,3-propanediol, 2,2-diethyl-1,3-propanediol, 1,8-octanediol, 1,9-nonanediol, 1,10-decanediol, 1,11-undecanediol and 1,12-dodecanediol. Specific examples of polyols include polyhydric alcohols such as trimethylolethane, trimethylolpropane, trimethylolbutane, di-(trimethylolpropane), tri-(trimethylolpropane), pentaerythritol, di-(pentaerythritol), tri-(pentaerythritol), glycerin, polyglycerins (2-20 mers of glycerin), 1,3,5-pentanetriol, sorbitol, sorbitan, sorbitol-glycerin condensate, adonitol, arabitol, xylitol and mannitol, saccharides such as xylose, arabinose, ribose, rhamnose, glucose, fructose, galactose, mannose, sorbose, cellobiose, maltose, isomaltose, trehalose, sucrose, raffinose, gentianose and melezitose, and their partial etherified forms, and methylglucosides (glucosides). Preferred among these as polyols are hindered alcohol such as neopentyl glycol, trimethylolethane, trimethylolpropane, trimethylolbutane, di-(trimethylolpropane), tri-(trimethylolpropane), pentaerythritol, di-(pentaerythritol) and tri-(pentaerythritol).

There are no particular restrictions on the number of carbon atoms in the fatty acid used for the polyol ester, but it will usually be C1-24. Among C1-24 fatty acids there are preferred those with 3 or more carbon atoms, more preferably 4 or more carbon atoms, even more preferably 5 or more carbon atoms and most preferably 10 or more carbon atoms, from the viewpoint of lubricity. From the viewpoint of compatibility with refrigerants, the number of carbon atoms is preferably no greater than 18, more preferably no greater than 12 and even more preferably no greater than 9.

The fatty acids may be straight-chain fatty acids or branched fatty acids, but from the viewpoint of lubricity they are preferably straight-chain fatty acids, while from the viewpoint of hydrolytic stability they are preferably branched fatty acids. The fatty acids may be either saturated fatty acids or unsaturated fatty acids.

Specific fatty acids include pentanoic acid, hexanoic acid, heptanoic acid, octanoic acid, nonanoic acid, decanoic acid, undecanoic acid, dodecanoic acid, tridecanoic acid, tetradecanoic acid, pentadecanoic acid, hexadecanoic acid, heptadecanoic acid, octadecanoic acid, nonadecanoic acid, eicosanoic acid and oleic acid, and these fatty acids may be straight-chain fatty acids or branched fatty acids, and they may be fatty acids in which the $\alpha$-carbon atom is a quaternary carbon atom (neo acids). Preferred for use among these are valeric acid (n-pentanoic acid), caproic acid (n-hexanoic acid), enanthic acid (n-heptanoic acid), caprylic acid (n-octanoic acid), pelargonic acid (n-nonanoic acid), capric acid (n-decanoic acid), oleic acid (cis-9-octadecenoic acid), isopentanoic acid (3-methylbutanoic acid), 2-methylhexanoic acid, 2-ethylpentanoic acid, 2-ethylhexanoic acid and 3,5,5-trimethylhexanoic acid.

The polyol ester used for the invention may be a partial ester with a portion of the hydroxyl groups of the polyol remaining without esterification, a complete ester with all of the hydroxyl groups esterified, or a mixture of a partial ester and a complete ester, so long as it has 2 or more ester groups, but it is preferably a complete ester.

A complex ester is an ester of a fatty acid and a dibasic acid with a monohydric alcohol and a polyol, and the fatty acids, dibasic acids, monohydric alcohols and polyols used may be the fatty acids, dibasic acids, monohydric alcohols and polyols mentioned above for explanation of dibasic acid esters and polyol esters.

A carbonic acid ester is a compound having a carbonic acid ester bond represented by the following formula (III-1):

$$—O—CO—O— \quad \text{(III-1)}$$

in the molecule. The number of carbonic acid ester bonds represented by formula (III-1) may be 1 or more per molecule.

As alcohols composing carbonic acid esters there may be used the monohydric alcohols and polyols mentioned above for explanation of dibasic acid esters and polyol esters, as well as polyglycols and polyglycol-added polyols. Compounds obtained from carbonic acid and fatty acids and/or dibasic acids may also be used.

When an ester is to be used, it may of course be used alone as a compound with a single structure, or 2 or more compounds with different structures may be used in combination.

Preferred among these esters are dibasic acid esters, polyol esters and carbonic acid esters, from the viewpoint of compatibility with refrigerants.

Among dibasic acid esters there are more preferred alicyclic dicarboxylic acid esters such as 1,2-cyclohexanedicarboxylic acid and 4-cyclohexene-1,2-dicarboxylic acid, from the viewpoint of compatibility with refrigerants and thermal and hydrolytic stability.

Specific examples of dibasic acid esters that may be preferably used for the invention include dibasic acid esters obtained from at least one monohydric alcohol selected from the group consisting of butanol, pentanol, hexanol, heptanol, octanol and nonanol, with at least one dibasic acid selected from the group consisting of 1,2-cyclohexanedicarboxylic acid and 4-cyclohexene-1,2-dicarboxylic acid, as well as mixtures of the foregoing.

It is preferred for the dibasic acid ester of the invention to have 2 or more monohydric alcohols composing the dibasic acid ester, since this will improve the low-temperature characteristics of the refrigerating machine oil composition and its compatibility with refrigerants. A dibasic acid ester composed of 2 or more monohydric alcohols is a mixture of 2 or more esters of dibasic acids and a single type of alcohol, or an ester of a dibasic acid and a mixture of 2 or more alcohols.

More preferred among these polyol esters, for more excellent hydrolytic stability, are esters of hindered alcohols such as neopentyl glycol, trimethylolethane, trimethylolpropane, trimethylolbutane, di-(trimethylolpropane), tri-(trimethylolpropane), pentaerythritol, di-(pentaerythritol) and tri-(pentaerythritol), more preferred are esters of neopentyl glycol, trimethylolethane, trimethylolpropane, trimethylolbutane and pentaerythritol, and most preferred are esters of pentaerythritol for particularly excellent compatibility with refrigerants and hydrolytic stability.

Specific examples of polyol esters preferred for use according to the invention are diesters, triesters and tetraesters obtained from at least one fatty acid selected from the group consisting of valeric acid, caproic acid, enanthic acid, caprylic acid, pelargonic acid, capric acid, oleic acid, isopentanoic acid, 2-methylhexanoic acid, 2-ethylpentanoic acid, 2-ethylhexanoic acid and 3,5,5-trimethylhexanoic acid, and at least one alcohol selected from the group consisting of neopentyl glycol, trimethylolethane, trimethylolpropane, trimethylolbutane and pentaerythritol, and mixtures of such esters.

It is preferred for a polyol ester of the invention to have 2 or more fatty acids composing the polyol ester, since this will improve the low-temperature characteristics of the refrigerating machine oil composition and its compatibility with refrigerants. Polyol esters composed of 2 or more different fatty acids include mixtures of 2 or more esters of a polyol and one type of fatty acid, and esters of a polyol and mixtures of 2 or more different fatty acids.

Preferred carbonic acid esters are those having a structure represented by the following formula (III-2):

$$(X^{11}O)_b—B—[O-(A^{11}O)_c—CO—O-(A^{12}O)_d—Y^{11}]_a \quad \text{(III-2)}$$

[in formula (III-2), $X^{11}$ represents hydrogen, alkyl, cycloalkyl or a group represented by the following formula (III-3):

$$Y^{12}—(OA^{13})_e- \quad \text{(III-3)}$$

(in formula (III-3), $Y^{12}$ represents hydrogen, alkyl or a cycloalkyl group, $A^{13}$ represents a C2-4 alkylene group, and e represents an integer of 1-50), $A^{11}$ and $A^{12}$ may be the same or different and each represents a C2-4 alkylene group, $Y^{11}$ represents hydrogen, alkyl or cycloalkyl, B represents a residue of a compound with 3-20 hydroxyl groups, a represents an integer of 1-20 and b represents an integer of 0-19, such that a+b is 3-20, c represents an integer of 0-50 and d represents an integer of 1-50].

In formula (III-2), $X^{11}$ represents hydrogen, alkyl, cycloalkyl or a group represented by formula (III-3) above. There are no particular restrictions on the number of carbon atoms in the aforementioned alkyl group, but it will usually be 1-24, preferably 1-18 and more preferably 1-12. The alkyl group may be either straight-chain or branched.

Specific C1-24 alkyl groups include methyl, ethyl, n-propyl, isopropyl, n-butyl, isobutyl, sec-butyl, tert-butyl, straight-chain or branched pentyl, straight-chain or branched hexyl, straight-chain or branched heptyl, straight-chain or branched octyl, straight-chain or branched nonyl, straight-chain or branched decyl, straight-chain or branched undecyl, straight-chain or branched dodecyl, straight-chain or branched tridecyl, straight-chain or branched tetradecyl, straight-chain or branched pentadecyl, straight-chain or branched hexadecyl, straight-chain or branched heptadecyl, straight-chain or branched octadecyl, straight-chain or branched nonadecyl, straight-chain or branched eicosyl, straight-chain or branched heneicosyl, straight-chain or branched docosyl, straight-chain or branched tricosyl and straight-chain or branched tetracosyl.

Specific cycloalkyl groups include cyclopentyl, cyclohexyl and cycloheptyl groups.

Specific C2-4 alkylene groups represented by $A^{13}$ in formula (III-2) include ethylene, propylene, trimethylene, butylene, tetramethylene, 1-methyltrimethylene, 2-methyltrimethylene, 1,1-dimethylethylene and 1,2-dimethylethylene.

In formula (III-2), $Y^{12}$ represents hydrogen, alkyl or cycloalkyl. There are no particular restrictions on the number of carbon atoms in the aforementioned alkyl group, but it will usually be 1-24, preferably 1-18 and more preferably 1-12. The alkyl group may be either straight-chain or branched. The C1-24 alkyl groups include the alkyl groups mentioned above in the explanation for $X^{11}$.

Specific cycloalkyl groups include cyclopentyl, cyclohexyl and cycloheptyl groups.

Among groups represented by $Y^{12}$ there are preferred hydrogen or C1-12 alkyl groups, and more preferably groups from among hydrogen, methyl, ethyl, n-propyl, iso-propyl, n-butyl, iso-butyl, sec-butyl, tert-butyl, n-pentyl, iso-pentyl, neo-pentyl, n-hexyl, iso-hexyl, n-heptyl, iso-heptyl, n-octyl, iso-octyl, n-nonyl, iso-nonyl, n-decyl, iso-decyl, n-undecyl, iso-undecyl, n-dodecyl and iso-dodecyl groups. Also, e represents an integer of 1-50.

The group represented by $X^{11}$ is preferably hydrogen, C1-12 alkyl or a group represented by formula (III-3) above, and more preferably one from among hydrogen, methyl, ethyl, n-propyl, iso-propyl, n-butyl, iso-butyl, sec-butyl, tert-butyl, n-pentyl, iso-pentyl, neo-pentyl, n-hexyl, iso-hexyl, n-heptyl, iso-heptyl, n-octyl, iso-octyl, n-nonyl, iso-nonyl, n-decyl, iso-decyl, n-undecyl, iso-undecyl, n-dodecyl, iso-dodecyl and groups represented by formula (III-3).

Compounds with B as a residue and having 3-20 hydroxyl groups include, specifically, the polyols mentioned above.

Also, $A^{11}$ and $A^{12}$ may be the same or different and each represents a C2-4 alkylene group. Specific alkylene groups include ethylene, propylene, trimethylene, butylene, tetramethylene, 1-methyltrimethylene, 2-methyltrimethylene, 1,1-dimethylethylene and 1,2-dimethylethylene.

Also, $Y^{11}$ represents hydrogen, alkyl or cycloalkyl. There are no particular restrictions on the number of carbon atoms in the aforementioned alkyl group, but it will usually be 1-24, preferably 1-18 and more preferably 1-12. The alkyl group may be either straight-chain or branched. The C1-24 alkyl groups include, specifically, the alkyl groups mentioned above in the explanation for $X^1$.

Specific cycloalkyl groups include cyclopentyl, cyclohexyl and cycloheptyl groups.

Among these, the group represented by $Y^{11}$ is preferably hydrogen or a C1-12 alkyl group, and more preferably a group from among hydrogen, methyl, ethyl, n-propyl, iso-propyl, n-butyl, iso-butyl, sec-butyl, tert-butyl, n-pentyl, iso-pentyl, neo-pentyl, n-hexyl, iso-hexyl, n-heptyl, iso-heptyl, n-octyl, iso-octyl, n-nonyl, iso-nonyl, n-decyl, iso-decyl, n-undecyl, iso-undecyl, n-dodecyl and iso-dodecyl groups.

In formulas (III-2) and (III-3), c, d and e represent the polymerization degree of the polyoxyalkylene chains, and the polyoxyalkylene chains in the molecule may be the same or different. When a carbonic acid ester represented by formula (III-2) has a plurality of different polyoxyalkylene chains, there are no particular restrictions on the polymerization form of the oxyalkylene groups, and it may be random copolymerization or block copolymerization.

The method of producing a carbonic acid ester to be used for the invention may be any desired one, and for example, it may be obtained by adding an alkylene oxide to a polyol compound to produce a polyalkyleneglycol polyol ether, and reacting this with chloroformate at 0-30° C., in the presence of an alkali metal hydroxide such as sodium hydroxide or potassium hydroxide, an alkali metal alkoxide such as sodium methoxide or sodium ethoxide, or an alkali such as metallic sodium. Alternatively, it may be obtained by reacting a carbonic acid source such as a carbonic acid diester or phosgene with a polyalkyleneglycol polyol ether at 80-150° C. in the presence of an alkali metal hydroxide such as sodium hydroxide or potassium hydroxide, an alkali metal alkoxide such as sodium methoxide or sodium ethoxide, or an alkali such as metallic sodium. The free hydroxyl groups may then be etherified if necessary.

The product obtained from the starting materials may be purified to remove the by-products and unreacted substances, but there is no problem if small amounts of by-products or unreacted substances remain, so long as they do not interfere with the excellent performance of the lubricant oil according to this embodiment.

When a carbonic acid ester is used for the invention, it may be used alone as a compound with a single structure, or 2 or more compounds with different structures may be used in combination. There are no particular restrictions on the molecular weight of a carbonic acid ester according to the invention, but from the viewpoint of further improving compressor sealability, the number-average molecular weight is preferably 200-4000 and more preferably 300-3000. The kinematic viscosity of the carbonic acid ester of the invention is preferably 2-150 $mm^2/s$ and more preferably 4-100 $mm^2/s$ at 100° C.

Examples of polyoxyalkylene glycols to be used in a base oil for this embodiment include compounds represented by the following formula (III-4):

$$R^{11}—[(OR^{12})_f—OR^{13}]_g \quad \text{(III-4)}$$

[in formula (III-4), $R^{11}$ represents hydrogen, C1-10 alkyl, C2-10 acyl or a residue of a compound with 2-8 hydroxyl groups, $R^{12}$ represents a C2-4 alkylene group, $R^{13}$ represents hydrogen, C1-10 alkyl or C2-10 acyl, f represents an integer of 1-80 and g represents an integer of 1-8].

In formula (III-4), alkyl groups represented by $R^{11}$ and $R^{13}$ may be straight-chain, branched or cyclic. Specific examples of alkyl groups include methyl, ethyl, n-propyl, isopropyl, straight-chain or branched butyl, straight-chain or branched pentyl, straight-chain or branched hexyl, straight-chain or branched heptyl, straight-chain or branched octyl, straight-chain or branched nonyl, straight-chain or branched decyl, cyclopentyl and cyclohexyl. If the alkyl group is greater than C10, the compatibility with refrigerants will tend to be reduced, and phase separation will tend to occur more easily. The preferred number of carbon atoms of the alkyl group is 1-6.

The alkyl group portions of acyl groups represented by $R^{11}$ and $R^{13}$ may also be straight-chain, branched or cyclic. Specific examples for the alkyl group portions of acyl groups include the alkyl groups mentioned as examples of alkyl groups above, which have 1-9 carbon atoms. If the acyl group is greater than C10, compatibility with refrigerants may be reduced and phase separation may occur. The preferred number of carbon atoms of the acyl group is 2-6.

When the groups represented by $R^{11}$ and $R^{13}$ are both alkyl groups, or when they are both acyl groups, the groups represented by $R^{11}$ and $R^{13}$ may be the same or different. When g is 2 or greater, the groups represented by $R^{11}$ and $R^{13}$ in the same molecule may be the same or different.

When the group represented by $R^{11}$ is a residue of a compound having 2-8 hydroxyl groups, the compound may be either linear or cyclic. Specific examples of compounds with 2 hydroxyl groups include ethylene glycol, 1,3-propanediol, propylene glycol, 1,4-butanediol, 1,2-butanediol, 2-methyl-1,3-propanediol, 1,5-pentanediol, neopentyl glycol, 1,6-hexanediol, 2-ethyl-2-methyl-1,3-propanediol, 1,7-heptanediol, 2-methyl-2-propyl-1,3-propanediol, 2,2-diethyl-1,3-propanediol, 1,8-octanediol, 1,9-nonanediol, 1,10-decanediol, 1,11-undecanediol and 1,12-dodecanediol.

Specific examples of compounds with 3-8 hydroxyl groups include polyhydric alcohols such as trimethylolethane, trimethylolpropane, trimethylolbutane, di-(trimethylolpropane), tri-(trimethylolpropane), pentaerythritol, di-(pentaerythritol), tri-(pentaerythritol), glycerin, polyglycerins (2-6 mers of glycerin), 1,3,5-pentanetriol, sorbitol, sorbitan, sorbitol-glycerin condensate, adonitol, arabitol, xylitol and mannitol, saccharides such as xylose, arabinose, ribose, rhamnose, glucose, fructose, galactose, mannose, sorbose, cellobiose, maltose, isomaltose, trehalose, sucrose, raffinose, gentianose and melezitose, and their partial etherified forms, and methylglucosides (glucosides).

Of the polyoxyalkylene glycols represented by formula (III-4), at least one of $R^{11}$ and $R^{13}$ is preferably an alkyl group (more preferably a C1-4 alkyl group), with methyl being especially preferred from the viewpoint of compatibility with refrigerants. From the viewpoint of thermal and chemical stability, both $R^{11}$ and $R^{13}$ are preferably alkyl groups (more preferably C1-4 alkyl groups), and most preferably both are methyl groups. From the viewpoint of facilitating production and lowering cost, preferably one of $R^{11}$ and $R^{13}$ is an alkyl group (more preferably a C1-4 alkyl group) while the other is hydrogen, and most preferably one is methyl and the other is hydrogen.

In formula (III-4), $R^2$ represents a C2-4 alkylene group, specific examples of alkylene groups including ethylene, propylene and butylene. Oxyalkylene groups as repeating units represented by $OR^2$ include oxyethylene, oxypropylene and oxybutylene groups. Multiple oxyalkylene groups in the same molecule may be the same, or they may include two different oxyalkylene groups.

Among polyoxyalkylene glycols represented by formula (III-4) there are preferred copolymers containing an oxyethylene group (EO) and an oxypropylene group (PO), from the viewpoint of refrigerant compatibility and the viscosity-temperature characteristic, in which case, from the viewpoint of the seizure load and the viscosity-temperature characteristic, the proportion of oxyethylene groups of the total oxyethylene and oxypropylene groups (EO/(PO+EO)) is preferably in the range of 0.1-0.8 and more preferably in the range of 0.3-0.6.

From the viewpoint of hygroscopicity and heat and oxidation stability, the value of EO/(PO+EO) is preferably in the range of 0-0.5, more preferably in the range of 0-0.2, and most preferably 0 (i.e. a propylene oxide homopolymer).

In formula (III-4), f is an integer of 1-80 and g is an integer of 1-8. For example, when $R^{11}$ is an alkyl group or acyl group, g is 1. When $R^{11}$ is a residue of a compound having 2-8 hydroxyl groups, g is the number of hydroxyl groups in the compound.

There are no particular restrictions on the product off and g (f×g), but the average value of f×g is preferably 6-80, to provide a satisfactory balance for the required performance as a lubricant oil for a refrigerating machine.

Preferred among polyoxyalkylene glycols having such a structure, from the viewpoint of economy and the effect described above, are polyoxypropyleneglycol dimethyl ethers represented by the following formula (III-5):

$$CH_3O—(C_3H_6O)_h—CH_3 \quad \text{(III-5)}$$

(wherein h represents an integer of 6-80), polyoxyethylene-polyoxypropyleneglycol dimethyl ethers represented by the following formula (III-6):

$$CH_3O—(C_2H_4O)_i—(C_3H_6O)_j—CH_3 \quad \text{(III-6)}$$

(wherein i and j are both 1 or greater, the total of i and j being an integer of 6-80), and preferred from the viewpoint of economy are polyoxypropyleneglycol monobutyl ethers represented by the following formula (III-7):

$$C_4H_9O—(C_3H_6O)_k—H \quad \text{(III-7)}$$

(wherein k represents an integer of 6-80), as well as polyoxypropyleneglycol monomethyl ethers represented by the following formula (III-8):

$$CH_3O—(C_3H_6O)_l—H \quad \text{(III-8)}$$

(wherein 1 represents an integer of 6-80), polyoxyethylene-polyoxypropyleneglycol monomethyl ethers represented by the following formula (III-9):

$$CH_3O—(C_2H_4O)_m—(C_3H_6O)_n—H \quad \text{(III-9):}$$

(wherein m and n are both 1 or greater, the total of m and n being an integer of 6-80), polyoxyethylene-polyoxypropyleneglycol monobutyl ethers represented by the following formula (III-10):

$$C_4H_9O—(C_2H_4O)_m—(C_3H_6O)_n—H \quad \text{(III-10)}$$

(wherein m and n are both 1 or greater, the total of m and n being an integer of 6-80), and polyoxypropyleneglycol diacetates represented by the following formula (III-11):

$$CH_3COO—(C_3H_6O)_1—COCH_3 \quad \text{(III-11)}$$

(wherein 1 represents an integer of 6-80).

Also, the polyoxyalkylene glycol used for the invention may be a polyoxyalkyleneglycol derivative having at least one structural unit represented by formula (III-12):

[Chemical Formula 1]

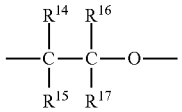

(III-12)

[in formula (III-12), $R^{14}$-$R^{17}$ may be the same or different and each represents hydrogen, a C1-10 monovalent hydrocarbon or a group represented by the following formula (III-13):

[Chemical Formula 2]

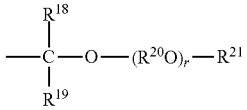

(III-13)

[in formula (III-13), $R^{18}$ and $R^{19}$ may be the same or different and each represents hydrogen, a C1-10 monovalent hydrocarbon or a C2-20 alkoxyalkyl group, $R^{2o}$ represents a C2-5 alkylene group, a total C2-5 substituted alkylene group having an alkyl group as a substituent or a total C4-10 substituted alkylene group having an alkoxyalkyl group as a substituent, r represents an integer of 0-20, and $R^{21}$ represents a C1-10 monovalent hydrocarbon group], at least one of $R^{18}$-$R^{21}$ being a group represented by formula (III-13)].

In formula (III-12), $R^{14}$-$R^{17}$ each represents hydrogen, a C1-10 monovalent hydrocarbon group or a group represented by formula (III-13), and specific C1-10 monovalent hydrocarbon groups include C1-10 straight-chain or branched alkyl, C2-10 straight-chain or branched alkenyl, C5-10 cycloalkyl or alkylcycloalkyl, C6-10 aryl or alkylaryl and C7-10 arylalkyl groups. Preferred among these monovalent hydrocarbon groups are ≤C6 monovalent hydrocarbon and especially ≤C3 alkyl groups, and specifically methyl, ethyl, n-propyl and isopropyl.

In formula (III-13), $R^{18}$ and $R^{19}$ each represent hydrogen, a C1-10 monovalent hydrocarbon group or a C2-20 alkoxyalkyl group, with ≤C3 alkyl groups or ≤C6 alkoxyalkyl groups being preferred. Specific ≤C3 alkyl groups include methyl, ethyl, n-propyl and isopropyl. Specific C2-6 alkoxyalkyl groups include methoxymethyl, ethoxymethyl, n-propoxymethyl, isopropoxymethyl, n-butoxymethyl, isobutoxymethyl, sec-butoxymethyl, tert-butoxymethyl, pentoxymethyl (including all isomers), methoxyethyl (including all isomers), ethoxyethyl (including all isomers), propoxyethyl, (including all isomers), butoxyethyl (including all isomers), methoxypropyl (including all isomers), ethoxypropyl (including all isomers), propoxypropyl (including all isomers), methoxybutyl (including all isomers), ethoxybutyl (including all isomers) and methoxypentyl (including all isomers).

In formula (III-13), $R^{20}$ represents C2-5 alkylene, a total C2-5 substituted alkylene group having an alkyl group as a substituent, or a total C4-10 substituted alkylene group having an alkoxyalkyl group as a substituent, and preferably it represents C2-4 alkylene or a total ≤C6 substituted ethylene group. Specific C2-4 alkylene groups include ethylene, propylene and butylene. Specifically, substituted ethylene groups with a total of no greater than 6 carbon atoms include 1-(methoxymethyl)ethylene, 2-(methoxymethyl)ethylene, 1-(methoxyethyl)ethylene, 2-(methoxyethyl)ethylene, 1-(ethoxymethyl)ethylene, 2-(ethoxymethyl)ethylene, 1-methoxymethyl-2-methylethylene, 1,1-bis(methoxymethyl)ethylene, 2,2-bis(methoxymethyl)ethylene, 1,2-bis(methoxymethyl)ethylene, 1-methyl-2-methoxymethylethylene, 1-methoxymethyl-2-methylethylene, 1-ethyl-2-methoxymethylethylene, 1-methoxymethyl-2-ethylethylene, 1-methyl-2-ethoxymethylethylene, 1-ethoxymethyl-2-methylethylene, 1-methyl-2-methoxyethylethylene and 1-methoxyethyl-2-methylethylene.

Also in formula (III-13), $R^{21}$ represents a C1-10 monovalent hydrocarbon group, where the hydrocarbon group may be, specifically, C1-10 straight-chain or branched alkyl, C2-10 straight-chain or branched alkenyl, C5-10 cycloalkyl or alkylcycloalkyl, C6-10 aryl or alkylaryl, or C7-10 arylalkyl. Of these there are preferred ≤C6 monovalent hydrocarbon groups, and especially ≤C3 alkyl groups, and specifically methyl, ethyl, n-propyl and isopropyl.

In formula (III-12), at least one of $R^{14}$-$R^{17}$ is a group represented by formula (III-13). Most preferably, one of $R^{14}$ and $R^{16}$ is a group represented by formula (III-13) while the other of $R^{14}$ and $R^{16}$, and groups $R^{15}$ and $R^{17}$, are each hydrogen or a C1-10 monovalent hydrocarbon group.

Polyoxyalkylene glycols having structural units represented by formula (III-12), that are preferably used for the invention, may be largely classified into 3 types: homopolymers composed entirely of structural units represented by formula (III-12); copolymers composed of 2 or more different structural units represented by formula (III-12) and having different structures; and copolymers composed of a structural unit represented by formula (III-12) and another structural unit, such as a structural unit represented by the following formula (III-14):

[Chemical Formula 3]

(III-13)

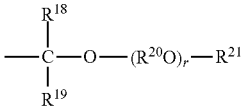

[in formula (III-14), $R^{22}$-$R^{25}$ may be the same or different and each represents hydrogen or a C1-3 alkyl group]. Preferred examples of the aforementioned homopolymers include those having 1-200 structural units A represented by formula (III-12), and having hydroxyl, C1-10 acyloxy, C1-10 alkoxy or aryloxy groups as the end groups. Preferred examples of copolymers, on the other hand, include those having 1-200 each of two different structural units A and B represented by formula (III-12), or having 1-200 structural units A represented by formula (III-12) and 1-200 structural units C represented by formula (III-12), and having hydroxyl, C1-10 acyloxy, C1-10 alkoxy or aryloxy groups as the end groups. These copolymers may have any polymerization form, such as alternating copolymerization, random copolymerization or block copolymerization of structural unit A and structural unit B (or structural unit C), or graft copolymerization with structural unit B grafted onto a main chain of structural unit A.

Also, examples of polyvinyl ethers to be used for the invention include polyvinyl ether-based compounds having structural units represented by the following formula (III-15):

[Chemical Formula 4]

(III-15)

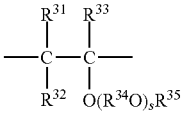

[in formula (III-15), $R^{31}$-$R^{33}$ may be the same or different and each represents hydrogen or a C1-8 hydrocarbon group, $R^{34}$ represents a C1-10 divalent hydrocarbon group or C2-20 divalent ether bonded oxygen-containing hydrocarbon group, $R^{35}$ represents a C1-20 hydrocarbon group, s represents an integer with an average value of 0-10, $R^{31}$-$R^{35}$ may be the same or different for each structural unit, and when the structural unit represented by formula (III-15) has multiple $R^{34}O$ groups, the $R^{34}O$ groups may be the same or different].

There may also be used polyvinyl ether-based compounds composed of block copolymers or random copolymers having a structural unit represented by the formula (III-15) above and a structural unit represented by the following formula (III-16):

[Chemical Formula 5]

(III-16)

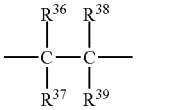

[in formula (III-16), $R^{36}$-$R^{39}$ may be the same or different and each represents hydrogen or a C1-20 hydrocarbon group, and $R^{36}$-$R^{39}$ may be the same or different for each structural unit].

In formula (III-15), each of $R^{31}$-$R^{33}$ represents hydrogen or a C1-8 hydrocarbon group (preferably a C1-4 hydrocarbon group), which may be the same or different from each other. Specific examples of such hydrocarbon groups include alkyl groups such as methyl, ethyl, n-propyl, isopropyl, n-butyl, isobutyl, sec-butyl, tert-butyl, pentyl groups, hexyl groups, heptyl groups and octyl groups; cycloalkyl groups such as cyclopentyl, cyclohexyl, methylcyclohexyl groups, ethylcyclohexyl groups and dimethylcyclohexyl groups; aryl groups such as phenyl, methylphenyl groups, ethylphenyl groups and dimethylphenyl groups; and arylalkyl groups such as benzyl, phenylethyl groups and methylbenzyl groups, with hydrogen being preferred for $R^{31}$-$R^{33}$.

The group $R^{34}$ in formula (III-15) above represents a C1-10 (preferably C2-10) divalent hydrocarbon group or a C2-20 divalent ether bonded oxygen-containing hydrocarbon group. Specific C1-10 divalent hydrocarbon groups include divalent aliphatic hydrocarbon groups such as methylene, ethylene, phenylethylene, 1,2-propylene, 2-phenyl-1,2-propylene, 1,3-propylene, butylene groups, pentylene groups, hexylene groups, heptylene groups, octylene groups, nonylene groups and decylene groups; alicyclic hydrocarbon groups with 2 binding sites in the alicyclic hydrocarbon, such as cyclohexane, methylcyclohexane, ethylcyclohexane, dimethylcyclohexane and propylcyclohexane; divalent aromatic hydrocarbon groups such as phenylene groups, methylphenylene groups, ethylphenylene groups, dimethylphenylene groups and naphthylene groups; alkylaromatic hydrocarbon groups having a monovalent binding site in both the alkyl group portion and the aromatic portion of the alkylaromatic hydrocarbon, such as toluene, xylene and ethylbenzene; and alkylaromatic hydrocarbons having a binding site in the alkyl group portion of a polyalkylaromatic hydrocarbon, such as xylene and diethylbenzene. C2-4 aliphatic-chain hydrocarbon groups are particularly preferred.

Specific preferred examples of C2-20 divalent ether bonded oxygen-containing hydrocarbon groups include methoxymethylene, methoxyethylene, methoxymethylethylene, 1,1-bismethoxymethylethylene, 1,2-bismethoxymethylethylene, ethoxymethylethylene, (2-methoxyethoxy)methylethylene and (1-methyl-2-methoxy)methylethylene. The symbol s in formula (III-15) represents the number of repeating $R^{34}O$ groups, and its average value is in the range of 0-10 and preferably 0-5. When multiple $R^{34}O$ groups are present in the same structural unit, the $R^{34}O$ groups may be the same or different.

Also, $R^{35}$ in formula (III-15) represents a C1-20 and preferably a C1-10 hydrocarbon group, and specific examples of such hydrocarbon groups include alkyl groups such as methyl, ethyl, n-propyl, isopropyl, n-butyl, isobutyl, sec-butyl, tert-butyl, pentyl groups, hexyl groups, heptyl groups, octyl groups, nonyl groups and decyl groups; cycloalkyl groups such as cyclopentyl, cyclohexyl, methylcyclohexyl groups, ethylcyclohexyl groups, propylcyclohexyl groups and dimethylcyclohexyl groups; aryl groups such as phenyl, methylphenyl groups, ethylphenyl groups, dimethylphenyl groups, propylphenyl groups, trimethylphenyl groups, butylphenyl groups and naphthyl groups; and arylalkyl groups such as benzyl, phenylethyl groups, methylbenzyl groups, phenylpropyl groups and phenylbutyl groups. The $R^{31}$-$R^{35}$ groups may be the same or different for each structural unit.

When the polyvinyl ether of the invention is a homopolymer composed entirely of structural units represented by formula (III-15), the carbon/oxygen molar ratio is preferably in the range of 4.2-7.0. If the molar ratio is less than 4.2 the hygroscopicity will tend to be excessively increased, and if it is greater than 7.0 the compatibility with refrigerants will tend to be reduced.

In formula (III-16), $R^{36}$-$R^{39}$ may be the same or different and each represents hydrogen or a C1-20 hydrocarbon group. C1-20 hydrocarbon groups include the hydrocarbon groups mentioned above for $R^{35}$ in formula (III-15). The $R^{36}$-$R^{39}$ groups may be the same or different for each structural unit.

When the polyvinyl ether of the invention is a block copolymer or random copolymer comprising a structural unit represented by formula (III-15) and a structural unit represented by formula (III-16), the carbon/oxygen molar ratio is preferably in the range of 4.2-7.0. If the molar ratio is less than 4.2 the hygroscopicity will tend to be excessively increased, and if it is greater than 7.0 the compatibility with refrigerants will tend to be reduced.

According to the invention, it is also possible to use a mixture of a homopolymer composed entirely of a structural unit represented by formula (III-15), with a block copolymer or random copolymer comprising a structural unit represented by formula (III-15) and a structural unit represented by formula (III-16). The homopolymer and copolymer may be produced, respectively, by polymerization of their corresponding vinyl ether-based monomers, and by copolymerization of corresponding hydrocarbon monomers having olefinic double bonds and vinyl ether-based monomers.

A polyvinyl ether used for the invention is preferably one in which one of the end structures is represented by the following formula (III-17) or (III-18):

[Chemical Formula 6]

(III-17)

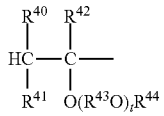

[in formula (III-17), $R^{40}$-$R^{44}$ may be the same or different and each represents hydrogen or a C1-8 hydrocarbon group, $R^{43}$ represents a C1-10 divalent hydrocarbon or C2-20 divalent ether bonded oxygen-containing hydrocarbon group, $R^{44}$ represents a C1-20 hydrocarbon group, t represents an integer with an average value of 0-10, and when the end structure represented by formula (III-17) has multiple $R^{43}O$ groups, the multiple $R^{43}O$ groups may be the same or different],

[Chemical Formula 7]

(III-18)

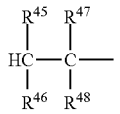

[in formula (III-18), $R^{45}$-$R^{48}$ may be the same or different and each represents hydrogen or a C1-20 hydrocarbon group], and the other has a structure represented by the following formula (III-19) or (III-20):

[Chemical Formula 8]

(III-19)

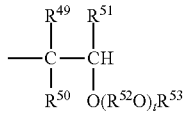

[in formula (III-19), $R^{49}$-$R^{51}$ may be the same or different and each represents hydrogen or a C1-8 hydrocarbon group, $R^{52}$ represents a C1-10 divalent hydrocarbon or a C2-20 divalent ether bonded oxygen-containing hydrocarbon group, $R^{53}$ represents a C1-20 hydrocarbon group, t represents an integer with an average value of 0-10, and when the end structure represented by formula (III-19) has multiple $R^{52}O$ groups, the multiple $R^{52}O$ groups may be the same or different],

[Chemical Formula 9]

(III-20)

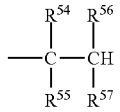

[in formula (III-20), $R^{54}$-$R^{57}$ may be the same or different and each represents hydrogen or a C1-20 hydrocarbon group];

or one in which one of the ends is represented by formula (III-17) or (III-18) above and the other has a structure represented by the following formula (III-21):

[Chemical Formula 10]

(III-21)

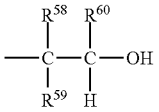

[in formula (III-21), $R^{58}$-$R^{60}$ may be the same or different and each represents hydrogen or a C1-8 hydrocarbon group]. Particularly preferred among these polyvinyl ethers are the following.

(1) Those having a structure wherein one end is represented by formula (III-17) or (III-18) and the other is represented by formula (III-19) or (III-20), all of $R^{31}$-$R^{33}$ in formula (III-15) are hydrogen, s is an integer of 0-4, $R^{34}$ is a C2-4 divalent hydrocarbon group, and $R^{35}$ is a C1-20 hydrocarbon group;

(2) Those having only a structural unit represented by formula (III-15), and having a structure wherein one end is represented by formula (III-17) and the other is represented by formula (III-18), all of $R^{31}$-$R^{33}$ in formula (III-15) are hydrogen, s is an integer of 0-4, $R^{34}$ is a C2-4 divalent hydrocarbon group, and $R^{35}$ is a C1-20 hydrocarbon group;

(3) Those having a structure wherein one end is represented by formula (III-17) or (III-18) and the other is represented by formula (III-19), all of $R^{31}$-$R^{33}$ in formula (III-15) are hydrogen, s is an integer of 0-4, $R^{34}$ is a C2-4 divalent hydrocarbon group, and $R^{35}$ is a C1-20 hydrocarbon group;

(4) Those having only a structural unit represented by formula (III-15), and having a structure wherein one end is represented by formula (III-17) and the other is represented by formula (III-20), all of $R^{31}$-$R^{33}$ in formula (III-15) are hydrogen, s is an integer of 0-4, $R^{34}$ is a C2-4 divalent hydrocarbon group, and $R^{35}$ is a C1-20 hydrocarbon group.

Also, according to the invention, there may be used a polyvinyl ether-based compound having a structural unit represented by formula (III-15) above, wherein one of the ends is represented by formula (III-17) and the other end is represented by the following formula (III-22):

[Chemical Formula 11]

(III-22)

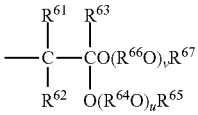

[in formula (III-22), $R^{61}$-$R^{63}$ may be the same or different and each represents hydrogen or a C1-8 hydrocarbon group, $R^{64}$ and $R^{66}$ may be the same or different and each represents a C2-10 divalent hydrocarbon group, $R^{65}$ and $R^{67}$ may be the same or different and each represents a C1-10 hydrocarbon group, u and v may be the same or different and each represents an integer with an average value of 0-10, and when the end structure represented by formula (III-22) has multiple $R^{64}O$ groups or $R^{66}O$ groups, the multiple $R^{64}O$ or $R^{66}O$ groups may be the same or different].

Also, according to the invention, there may be used a polyvinyl ether-based compound comprising an alkylvinyl ether homopolymer or copolymer comprising a structural unit represented by the following formula (III-23) or (III-24):

[Chemical Formula 12]

(III-23)

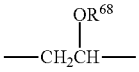

[in formula (III-23), $R^{68}$ represents a C1-8 hydrocarbon group]

[Chemical Formula 13]

(III-24)

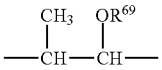

[in formula (III-24), $R^{69}$ represents a C1-8 hydrocarbon group], and having a weight-average molecular weight of 300-5000, with one end having a structure represented by the following formula (III-25) or (III-26):

[Chemical Formula 14]

(III-25)

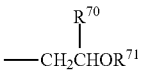

[in formula (III-25), $R^{70}$ represents a C1-3 alkyl group and $R^{71}$ represents a C1-8 hydrocarbon group]

Chemical Formula 15

$$—CH{=}CHOR^{72} \quad \text{(III-26)}$$

[in formula (III-26), $R^{72}$ represents a C1-8 hydrocarbon group].

3,4,5-Trihydroxybenzoic Acid Ester

According to the invention, an ester of 3,4,5-trihydroxybenzoic acid is added, and the ester is preferably synthesized by esterification reaction of 3,4,5-trihydroxybenzoic acid with a C1-18 alkyl alcohol, and specifically at least one from among methanol, ethanol, n-propyl alcohol, isopropyl alcohol, n-butyl alcohol, isobutyl alcohol, sec-butyl alcohol, tert-butyl alcohol, pentanol, hexanol, heptanol, octanol, nonanol, decanol, undecanol, dodecanol, tridecanol, tetradecanol, pentadecanol, hexadecanol, heptadecanol and octadecanol.

Alkyl esters of 3,4,5-trihydroxybenzoic acid include methyl esters, ethyl esters, propyl esters, butyl esters, pentyl esters, hexyl esters, heptyl esters, octyl esters, nonyl esters, decyl esters, undecyl esters, dodecyl esters, tridecyl esters, tetradecyl esters, pentadecyl esters, hexadecyl esters, heptadecyl esters and octadecyl esters, but esters of alcohols with high carbon numbers have excessively high solubility, i.e. high affinity, with oxygen-containing compound-based oils, resulting in lower concentration at sliding sections, and a low lubricity-improving effect. Conversely, esters with low carbon-number alcohols such as methanol have low solubility in base oils, and therefore do not reach concentrations sufficient to exhibit a lubricity-improving effect, while also having inferior hydrolytic stability.

As a result of multifaceted research, it was found that C2-12 alkyl esters of 3,4,5-trihydroxybenzoic acid are suitable from the viewpoint of balance between solubility in base oils and the lubricity-improving effect, and the invention has been completed upon this finding. The C2-12 alkyl groups may be straight-chain or branched, and C2 and C3 ethyl, n-propyl and isopropyl groups are especially preferred.

The content of the C2-12 alkyl ester in the 3,4,5-trihydroxybenzoic acid is 5-5000 ppm by mass, and preferably 10-2000 ppm by mass, based on the total mass of the lubricating oil composition. With addition at less than 5 ppm by mass, it is not possible to sufficiently reduce wear, lower the frictional coefficient and achieve a rust-preventing effect, while 5000 ppm by mass is approximately the limit for dissolution in oxygen-containing compound-based oils.

When the lubricating oil composition of this embodiment is to be used as a refrigerating machine oil, the content of the 3,4,5-trialkyl hydroxybenzoate ester is 5-500 ppm by mass, preferably 10-300 ppm and even more preferably 20-100 ppm, based on the total mass of the composition. If the content is too low the wear resistance effect may not be sufficient, while if it is too high, wear will tend to be accelerated.

[Phosphoric Acid Compound]

As the phosphorus compound in the lubricating oil composition of this embodiment, there may be added one or more phosphorus compounds selected from the group consisting of phosphoric acid esters, acidic phosphoric acid esters, thiophosphoric acid esters, acidic phosphoric acid ester amine salts, chlorinated phosphoric acid esters and phosphorous acid esters. These phosphorus compounds are esters of phosphoric acid or phosphorous acid with alkanols or polyether alcohols, or derivatives thereof.

Specific examples of phosphoric acid esters include tributyl phosphate, tripentyl phosphate, trihexyl phosphate, triheptyl phosphate, trioctyl phosphate, trinonyl phosphate, tridecyl phosphate, triundecyl phosphate, tridodecyl phosphate, tritridecyl phosphate, tritetradecyl phosphate, tripentadecyl phosphate, trihexadecyl phosphate, triheptadecyl phosphate, trioctadecyl phosphate, trioleyl phosphate, triphenyl phosphate, tricresyl phosphate, trixylenyl phosphate, cresyldiphenyl phosphate and xylenyldiphenyl phosphate.

Acidic phosphoric acid esters include monobutyl acid phosphate, monopentyl acid phosphate, monohexyl acid phosphate, monoheptyl acid phosphate, monooctyl acid phosphate, monononyl acid phosphate, monodecyl acid phosphate, monoundecyl acid phosphate, monododecyl acid phosphate, monotridecyl acid phosphate, monotetradecyl acid phosphate, monopentadecyl acid phosphate, monohexadecyl acid phosphate, monoheptadecyl acid phosphate, monooctadecyl acid phosphate, monooleyl acid phosphate, dibutyl acid phosphate, dipentyl acid phosphate, dihexyl acid phosphate, diheptyl acid phosphate, dioctyl acid phosphate, dinonyl acid phosphate, didecyl acid phosphate, diundecyl acid phosphate, didodecyl acid phosphate, ditridecyl acid phosphate, ditetradecyl acid phosphate, dipentadecyl acid phosphate, dihexadecyl acid phosphate, diheptadecyl acid phosphate, dioctadecyl acid phosphate and dioleyl acid phosphate.

Thiophosphoric acid esters include tributyl phosphorothionate, tripentyl phosphorothionate, trihexyl phosphorothionate, triheptyl phosphorothionate, trioctyl phosphorothionate, trinonyl phosphorothionate, tridecyl phosphorothionate, triundecyl phosphorothionate, tridodecyl phosphorothionate, tritridecyl phosphorothionate, tritetradecyl phosphorothionate, tripentadecyl phosphorothionate, trihexadecyl phosphorothionate, triheptadecyl phosphorothionate, trioctadecyl phosphorothionate, trioleyl phosphorothionate, triphenyl phosphorothionate, tricresyl phosphorothionate, trixylenyl phosphorothionate, cresyldiphenyl phosphorothionate and xylenyldiphenyl phosphorothionate.

Acidic phosphoric acid ester amine salts include amine salts of acidic phosphoric acid esters and C1-24 and preferably C5-18 primary to tertiary straight-chain or branched alkyl group amines.

Amines composing amine salts of acidic phosphoric acid esters include straight-chain and branched amines such as methylamine, ethylamine, propylamine, butylamine, pentylamine, hexylamine, heptylamine, octylamine, nonylamine, decylamine, undecylamine, dodecylamine, tridecylamine, tetradecylamine, pentadecylamine, hexadecylamine, heptadecylamine, octadecylamine, oleylamine, tetracosylamine, dimethylamine, diethylamine, dipropylamine, dibutylamine, dipentylamine, dihexylamine, diheptylamine, dioctylamine, dinonylamine, didecyl amine, diundecylamine, didodecylamine, ditridecylamine, ditetradecylamine, dipentadecylamine, dihexadecylamine, diheptadecylamine, dioctadecylamine, dioleylamine, ditetracosylamine, trimethylamine, triethylamine, tripropylamine, tributylamine, tripentylamine, trihexylamine, triheptylamine, trioctylamine, trinonyl amine, tridecylamine, tiundecylamine, tridodecylamine, tritridecylamine, tritetradecylamine, tripentadecylamine, trihexadecylamine, triheptadecylamine, trioctadecylamine and trioleylaminetritetracosylamine. The amine may be a simple compound or a mixture of two or more different compounds.

As chlorinated phosphoric acid esters there may be mentioned tris(dichloropropyl)phosphate, tris(chloroethyl)phosphate, tris(chlorophenyl)phosphate and polyoxyalkylene bis [di(chloroalkyl)]phosphate. Phosphorous acid esters include dibutyl phosphite, dipentyl phosphite, dihexyl phosphite, diheptyl phosphite, dioctyl phosphite, dinonyl phosphite, didecyl phosphite, diundecyl phosphite, didodecyl phosphite, dioleyl phosphite, diphenyl phosphite, dicresyl phosphite, tributyl phosphite, tripentyl phosphite, trihexyl phosphite, triheptyl phosphite, trioctyl phosphite, trinonyl phosphite, tridecyl phosphite, triundecyl phosphite, tridodecyl phosphite, trioleyl phosphite, triphenyl phosphite and tricresyl phosphite. Mixtures of the above compounds may also be used.

Preferred as phosphoric acid esters are aryl types, including triphenyl phosphate (TPP), tricresyl phosphate (TCP) or acidic phosphoric acid ester amine salts, from the viewpoint of balance between stability and lubricity, and they are added at 0.001-10.0% by mass and preferably 0.005-5.0% by mass. An amount of less than 0.001% by mass will result in almost no lubricity-improving effect, while an amount of greater than 10.0% by mass will tend to produce phosphoric acid, thus lowering the stability.

[Other Additives]

The lubricating oil composition of this embodiment may further comprise additives conventionally used in lubricant oils and greases, such as friction modifiers, anti-wear agents, extreme-pressure agents, antioxidants, rust-preventive agents, metal inactivating agents, detergent dispersants, antifoaming agents and the like, in ranges that do not interfere with the object of the invention, for even greater improvement in performance.

Friction modifiers include the organic molybdenum compounds molybdenum dithiocarbamate and molybdenum dithiophosphate, nitrogen-containing compounds such as aliphatic amines, aliphatic amides and aliphatic imides, alcohols, esters, phosphorous acid ester amine salts and the like, anti-wear agents include zinc dialkyldithiophosphates and the like, extreme-pressure agents include sulfurized olefins, sulfurized fats and oils and the like, antioxidants include amine-based and phenol-based antioxidants, rust-preventive agents include alkenylsuccinic acid esters or partial esters and the like, metal inactivating agents include benzotriazole and benzotriazole derivatives, detergent dispersants include metal cleaning agents such as alkaline earth metal sulfonates, alkaline earth metal phenates and alkaline earth metal salicylates, or ash-free dispersing agents such as polyalkenylsuccinic acid imides and polyalkenylsuccinic acid esters, and antifoaming agents include silicone compounds, ester-based antifoaming agents, and the like.

Suitable uses for the lubricating oil composition of this embodiment include lubrication of iron-based sliding sections made of iron or iron alloys, and use as hydraulic oils, compressor oils and internal combustion engine lubricant oils, or biodegradable lubricant oils. Trends continue toward the use of biodegradable lubricant oils, and toward viscosity reduction for reduced power consumption, which are preferred for ester-based or ether-based refrigerant compressor lubricant oils, i.e. refrigerating machine oils, where lubricity is an issue. Propyl 3,4,5-trihydroxybenzoate has been approved as a food additive and presents no problems from a safety standpoint.

When the lubricating oil composition of this embodiment is to be used as a refrigerating machine oil, it may also contain added terpene compounds for further improved thermal and chemical stability. A "terpene compound" according to the invention is a compound obtained by polymerization of isoprene or a derivative thereof, and isoprene 2-8 mers are preferably used. As terpene compounds there may be mentioned, specifically, monoterpenes such as geraniol, nerol, linalool, citrals (including geranial), citronellol, menthol, limonene, terpinerol, carvone, ionone, thujone, camphor and borneol, sesquiterpenes such as farnesene, farnesol, nerolidol, juvenile hormone, humulene, caryophyllene, elemen, cadinol, cadinene and tutin, diterpenes such as geranylgeraniol, phytol, abietic acid, pimaradiene, daphnetoxin, taxol, abietic acid and pimaric acid, sestaterpenes such as geranyl farnesene, triterpenes such as squalene, limonin, camelliagenin, hopane and lanosterol, and tetraterpenes such as carotenoids.

Preferred among these terpene compounds are monoterpenes, sesquiterpenes and diterpenes, with sesquiterpenes being more preferred and α-farnesene (3,7,11-trimethyldodeca-1,3,6,10-tetraene) and/or β-farnesene (7,11-dimethyl-3-methylidenedodeca-1,6,10-triene) being especially preferred. According to the invention, a single type of terpene compound may be used alone, or two or more different ones may be used in combination.

There are no particular restrictions on the content of terpene compounds in the refrigerating machine oil of this embodiment, but it is preferably 0.001-10% by mass, more preferably 0.01-5% by mass and even more preferably 0.05-3% by mass based on the total mass of the refrigerating machine oil. A terpene compound content of less than 0.001% by mass will tend to result in an insufficient improving effect on the thermal and chemical stability, while a content of greater than 10% by mass will tend to result in insufficient lubricity. The content of terpene compounds in the operating fluid composition for a refrigerator according to this embodiment is preferably selected so as to fall within the aforementioned preferred range based on the total weight of the refrigerating machine oil.

In order to further improve the thermal and chemical stability when the lubricating oil composition of this embodiment is used as a refrigerating machine oil, it may contain one or more epoxy compounds selected from among phenyl glycidyl ether-type epoxy compounds, alkyl glycidyl ether-type epoxy compounds, glycidyl ester-type epoxy compounds, allyloxirane compounds, alkyloxirane compounds, alicyclic epoxy compounds, epoxidated fatty acid monoesters and epoxidated vegetable oils.

Specific examples of phenyl glycidyl ether-type epoxy compounds include phenyl glycidyl ethers and alkylphenyl glycidyl ethers. The alkylphenyl glycidyl ethers referred to here may have 1-3 C1-13 alkyl groups, preferred examples of which include those with one C4-10 alkyl group such as n-butylphenyl glycidyl ether, i-butylphenyl glycidyl ether, sec-butylphenyl glycidyl ether, tert-butylphenyl glycidyl ether, pentylphenyl glycidyl ether, hexylphenyl glycidyl ether, heptylphenyl glycidyl ether, octylphenyl glycidyl ether, nonylphenyl glycidyl ether and decylphenyl glycidyl ether.

Specific examples of alkyl glycidyl ether-type epoxy compounds include decyl glycidyl ether, undecyl glycidyl ether, dodecyl glycidyl ether, tridecyl glycidyl ether, tetradecyl glycidyl ether, 2-ethylhexyl glycidyl ether, neopentyl glycol diglycidyl ether, trimethylolpropane triglycidyl ether, pentaerythritol tetraglycidyl ether, 1,6-hexanediol diglycidyl ether, sorbitol polyglycidyl ether, polyalkyleneglycol monoglycidyl ether and polyalkyleneglycol diglycidyl ether.

As specific examples of glycidyl ester-type epoxy compounds there may be mentioned phenylglycidyl esters, alkylglycidyl esters and alkenylglycidyl esters, among which preferred examples include glycidyl-2,2-dimethyl octanoate, glycidyl benzoate, glycidyl acrylate and glycidyl methacrylate.

Specific examples of allyloxirane compounds include 1,2-epoxystyrene and alkyl-1,2-epoxystyrenes.

Specific examples of alkyloxirane compounds include 1,2-epoxybutane, 1,2-epoxypentane, 1,2-epoxyhexane, 1,2-epoxyheptane, 1,2-epoxyoctane, 1,2-epoxynonane, 1,2-epoxydecane, 1,2-epoxyundecane, 1,2-epoxydodecane, 1,2-epoxytridecane, 1,2-epoxytetradecane, 1,2-epoxypentadecane, 1,2-epoxyhexadecane, 1,2-epoxyheptadecane, 1,1,2-epoxyoctadecane, 2-epoxynonadecane and 1,2-epoxyeicosane.

Specific examples of alicyclic epoxy compounds include 1,2-epoxycyclohexane, 1,2-epoxycyclopentane, 3,4-epoxycyclohexylmethyl-3,4-epoxycyclohexane carboxylate, bis(3,4-epoxycyclohexylmethyl)adipate, exo-2,3-epoxynorbornane, bis(3,4-epoxy-6-methylcyclohexylmethyl)adipate, 2-(7-oxabicyclo[4.1.0]hept-3-yl)-spiro(1,3-dioxane-5,3'-[7]oxabicyclo[4.1.0]heptane, 4-(1'-methylepoxyethyl)-1,2-epoxy-2-methylcyclohexane and 4-epoxyethyl-1,2-epoxycyclohexane.

Specific examples of epoxidated fatty acid monoesters include epoxidated esters of C12-20 fatty acids and C1-8 alcohols or phenols or alkylphenols. Most preferably used are butyl, hexyl, benzyl, cyclohexyl, methoxyethyl, octyl, phenyl and butylphenyl esters of epoxystearic acid.

Specific examples of epoxidated vegetable oils include epoxy compounds of vegetable oils such as soybean oil, linseed oil and cottonseed oil.

Preferred among these epoxy compounds are phenyl glycidyl ether-type epoxy compounds, alkyl glycidyl ether-type epoxy compounds, glycidyl ester-type epoxy compounds, and alicyclic epoxy compounds.

When the lubricating oil composition of this embodiment is to be used as a refrigerating machine oil, and it contains the aforementioned epoxy compound, the epoxy compound content is not particularly restricted but is preferably 0.01-5.0% by mass and more preferably 0.1-3.0% by mass based on the total mass of the refrigerating machine oil. A single epoxy compound may be used, or two or more may be used in combination.

When the lubricating oil composition of this embodiment is to be used as a refrigerating machine oil, conventionally known refrigerating machine oil additives may be added as necessary in order to further increase the performance.

Examples of such additives include phenol-based antioxidants such as di-tert-butyl-p-cresol and bisphenol A, amine-based antioxidants such as phenyl-α-naphthylamine and N,N-di(2-naphthyl)-p-phenylenediamine, anti-wear agents such as zinc dithiophosphate, extreme-pressure agents such as chlorinated paraffins and sulfur compounds, oil agents such as fatty acids, silicone-based and other types of anti-foaming agents, metal inactivating agents such as benzotriazoles, acid scavengers such as carbodiimides, viscosity index improvers, pour point depressants, detergent dispersants and the like. Such additives may be used alone or in combinations of two or more. There are no particular restrictions on the content of such additives, but it is preferably no greater than 10% by mass and more preferably no greater than 5% by mass based on the total mass of the refrigerating machine oil.

The kinematic viscosity of the refrigerating machine oil of this embodiment is not particularly restricted, but the 40° C. kinematic viscosity is preferably 3-1000 $mm^2/s$, more preferably 4-500 $mm^2/s$ and most preferably 5-400 $mm^2/s$. The 100° C. kinematic viscosity is preferably 2-50 $mm^2/s$ and more preferably 3-40 $mm^2/s$. If the kinematic viscosity is below this lower limit it will not be possible to obtain the necessary viscosity as a refrigerating machine oil, while if it is above the upper limit, the compatibility with refrigerants will tend to be insufficient.

There are no particular restrictions on the volume resistivity of the refrigerating machine oil of this embodiment, but since high electrical insulating properties tend to be necessary, particularly when the oil is to be used for a closed refrigerating machine, it is preferably $1.0\times10^{12}$ Ω·cm or greater, more preferably $1.0\times10^{13}$ Ω·cm or greater and most preferably $1.0\times10^{14}$ Ω·cm or greater. According to the invention, the volume resistivity is the value measured according to JIS C2101, "Electrical Insulation Oil Test Method", at 25° C.

The moisture content of the refrigerating machine oil of this embodiment is not particularly restricted but is preferably no greater than 200 ppm, more preferably no greater than 100 ppm and most preferably no greater than 50 ppm based on the total mass of the refrigerating machine oil. A lower moisture content is desired from the viewpoint of effect on the thermal and chemical stability and electrical insulating properties of the refrigerating machine oil, especially for use for a closed refrigerating machine.

The acid value of the refrigerating machine oil of this embodiment is also not particularly restricted, but in order to prevent corrosion of metals used in the refrigerating machine or pipings, it is preferably no greater than 0.1 mgKOH/g and more preferably no greater than 0.05 mgKOH/g. According to the invention, the acid value is the value measured based on JIS K2501, "Petroleum Products And Lubricant Oils—Neutralization Value Test Method".

The ash content of the refrigerating machine oil of this embodiment is not particularly restricted, but in order to increase the thermal and chemical stability of the refrigerating machine oil and inhibit generation of sludge, it is preferably no greater than 100 ppm and more preferably no greater than 50 ppm. According to the invention, the ash content is the value measured based on JIS K2272, "Crude Oil/Petroleum Product Ash Content and Sulfated Ash Content Test Method".

The refrigerating machine oil of this embodiment exhibits sufficiently high lubricity when used together with various refrigerants, and it may be widely used as a refrigerating machine oil for a refrigerating machine for various types of refrigerants. Specific refrigerating machines in which the refrigerating machine oil of this embodiment may be used include cooling devices in room air conditioners, package air conditioners, refrigerators, automobile air conditioners, dehumidifiers, freezers, freezing/refrigerating warehouses, automatic vending machines, showcases, chemical plants and the like, among which refrigerating machines with closed compressors are particularly preferred. The refrigerating machine oil of this embodiment may also be used in a compressor with a reciprocating, rotating or centrifugal system. The refrigerating machine oil of this embodiment in such a refrigerating machine may be used as an operating fluid composition for a refrigerating machine, in combination with a refrigerant, as described hereunder.

Specifically, the operating fluid composition for a refrigerating machine according to this embodiment comprises a refrigerating machine oil according to this embodiment as described above, and a refrigerant. There are no particular restrictions on the mixing ratio of the refrigerating machine oil and the refrigerant in the operating fluid composition for a refrigerating machine according to this embodiment, but the refrigerating machine oil content will usually be 1-1000 parts by mass and preferably 2-800 parts by mass with respect to 100 parts by mass of the refrigerant.

The refrigerant in the operating fluid composition for a refrigerating machine according to this embodiment may be an HFC refrigerant, unsaturated hydrocarbon fluoride (HFO) refrigerant, trifluoroiodomethane refrigerant, a fluorine-containing ether-based refrigerant such as perfluoroether, a non-fluorine-containing ether-based refrigerant such as dimethyl ether, or a natural refrigerant such as ammonia, carbon dioxide ($CO_2$) or a hydrocarbon.

HFC refrigerants include C1-3 and preferably C1-2 hydrofluorocarbons. Specific examples include difluoromethane (HFC-32), trifluoromethane (HFC-23), pentafluoroethane (HFC-125), 1,1,2,2-tetrafluoroethane (HFC-134), 1,1,1,2-tetrafluoroethane (HFC-134a), 1,1,1-trifluoroethane (HFC-143a), 1,1-difluoroethane (HFC-152a), fluoroethane (HFC-161), 1,1,1,2,3,3,3-heptafluoropropane (HFC-227ea), 1,1,1,2,3,3-hexafluoropropane (HFC-236ea), 1,1,1,3,3,3-hexafluoropropane (HFC-236fa), 1,1,1,3,3-pentafluoropropane (HFC-245fa), 1,1,1,3,3-pentafluorobutane (HFC-365 mfc), and mixtures of two or more of the foregoing. These refrigerants may be appropriately selected depending on the purpose of use and the required performance, but preferred examples include HFC-32 alone; HFC-23 alone; HFC-134a alone; HFC-125 alone; HFC-134a/HFC-32=60-80% by mass/40-20% by mass mixture; HFC-32/HFC-125=40-70% by mass/60-30% by mass mixture: HFC-125/HFC-143a=40-60% by mass/60-40% by mass mixture; HFC-134a/HFC-32/HFC-125=60% by mass/30% by mass/10% by mass mixture; HFC-134a/HFC-32/HFC-125=40-70% by mass/15-35% by mass/5-40% by mass mixture; and HFC-125/HFC-134a/HFC-143a=35-55% by mass/1-15% by mass/40-60% by mass mixture. More specifically, these include HFC-134a/HFC-32=70/30% by mass mixture; HFC-32/HFC-125=60/40% by mass mixture; HFC-32/HFC-125=50/50% by mass mixture (R410A); HFC-32/HFC-125=45/55% by mass mixture (R410B); HFC-125/HFC-143a=50/50% by mass mixture (R507C); HFC-32/HFC-125/HFC-134a=30/10/60% by mass mixture; HFC-32/HFC-125/HFC-134a=23/25/52% by mass mixture (R407C); HFC-32/HFC-125/HFC-134a=25/15/60% by mass mixture (R407E); and HFC-125/HFC-134a/HFC-143a=44/4/52% by mass mixture (R404A).

The unsaturated fluorinated hydrocarbon (HFO) refrigerant is preferably a fluoropropene with 3-5 fluorine atoms, and it is preferably one or a mixture of 2 or more from among 1,2,3,3,3-pentafluoropropene (HFO-1225ye), 1,3,3,3-tetrafluoropropene (HFO-1234ze), 2,3,3,3-tetrafluoropropene (HFO-1234yf), 1,2,3,3-tetrafluoropropene (HFO-1234ye) and 3,3,3-trifluoropropene (HFO-1243zf). From the viewpoint of refrigerant properties, it is preferred to use one or more selected from among HFO-1225ye, HFO-1234ze and HFO-1234yf.

As hydrocarbon refrigerants there are preferred C1-5 hydrocarbons, and specific examples include methane, ethylene, ethane, propylene, propane (R290), cyclopropane, normal-butane, isobutane, cyclobutane, methylcyclopropane, 2-methylbutane, normal-pentane, and mixtures of two or more of the foregoing. Preferred among these are refrigerants that are gases at 25° C., 1 atmosphere, such as propane, normal-butane, isobutane, 2-methylbutane, and mixtures thereof.

Specific examples of fluorinated ether-based refrigerants include HFE-134p, HFE-245mc, HFE-236mf, HFE-236me, HFE-338mcf, HFE-365mcf, HFE-245mf, HFE-347mmy, HFE-347mcc, HFE-125, HFE-143m, HFE-134m, HFE-227me and the like, and these refrigerants may be appropriately selected depending on the purpose of use and the required performance.

The refrigerating machine oil and operating fluid composition for a refrigerating machine of this embodiment is preferably used in an air conditioner or refrigerator with a reciprocating or rotating closed compressor, or in an open or closed automobile air conditioner. The refrigerating machine oil and operating fluid composition for a refrigerating machine according to this embodiment may also be suitably used in cooling devices of dehumidifiers, hot water suppliers, freezers, freezing/refrigerating warehouses, automatic vending machines, showcases, chemical plants and the like. The refrigerating machine oil and operating fluid composition for a refrigerating machine according to this embodiment may also be suitably used in devices with centrifugal compressors.

The operating fluid composition for a refrigerating machine according to this embodiment may be suitably used in refrigerating machines for various refrigerants, as mentioned above, and a typical construction of a refrigerant circulation cycle comprising the refrigerating machine is provided with a compressor, a condenser, an expansion mechanism and an evaporator, and if necessary a desiccator.

Examples of compressors include high-pressure container-type compressors housing a motor comprising a rotor and a stator in a sealed container storing a refrigerating machine oil, a rotation axis fitted in the rotor, and a compressor that is linked to the motor via the rotation axis, wherein high-pressure refrigerant gas discharged by the compressor is retained in the sealed container, and low-pressure container-type compressors housing a motor comprising a rotor and a stator in a sealed container storing a refrigerating machine oil, a rotation axis fitted in the rotor, and a compressor linked to the motor via the rotation axis, wherein high-pressure refrigerant gas discharged by the compressor is directly ejected out of the sealed container.

As insulating films for use as electrical insulating system materials in motors, it is preferred to use crystalline plastic films with glass transition points of 50° C. or higher, and specifically one or more insulating films selected from the group consisting of polyethylene terephthalate, polybutylene terephthalate, polyphenylene sulfide, polyetheretherketone, polyethylene naphthalate, polyamideimide and polyimide films, or composite films comprising a resin layer with a high glass transition temperature covering a film with a low glass transition temperature, because they are resistant to degradation of tensile strength properties and electrical insulation properties. Magnet wires used in motors are preferably ones having an enamel coating with a glass transition temperature of 120° C. or higher, such as a single polyester, polyesterimide, polyamide or polyamideimide layer, or an enamel coating that is a composite coating comprising a layer with a low glass transition temperature as the lower layer and a layer with a high glass transition temperature as the upper layer. Enamel wires with composite coatings include those comprising a polyesterimide as the lower layer and a polyamideimide coated as the upper layer (AI/EI), and those comprising a polyester as the lower layer and a polyamideimide coated as the upper layer (AI/PE).

As desiccants for packing into desiccators, there are preferably used synthetic zeolites comprising silicic acid and alkali aluminate metal complex salts, having a carbon dioxide gas absorption volume of no greater than 1.0%, with a pore size of no greater than 3.3 angstrom and a carbon dioxide gas partial pressure of 250 mmHg at 25° C. Specific examples include XH-9, XH-10, XH-11 and XH-600, trade names of Union Showa, KK.

EXAMPLES

The present invention will now be explained in greater detail based on examples and comparative examples, with the understanding that the invention is in no way limited to the examples.

[Preparation of Lubricating Oil Compositions]

The 3,4,5-trihydroxybenzoic acid esters, phosphoric acid esters, lubricant base oils and other additives shown below were used to prepare lubricating oil compositions for the examples and comparative examples, by blending in the mixing proportions shown in Tables 1 and 2 (where the additive amounts are % by mass based on the total mass of the composition). The properties of the base oils and of the lubricant oils of the examples and comparative examples were measured according to JIS K2283 for the viscosity and viscosity index, JIS K2269 for the pour point and JIS K2265-4 for the flash point.

(A) Wear Resistance Additives (3,4,5-trihydroxybenzoic Acid Esters, Phosphoric Acid Esters)

(A1) Propyl (n-propyl) 3,4,5-trihydroxybenzoate ester [product of Iwate Chemical Corp.]

(A2) Octyl (n-octyl) 3,4,5-trihydroxybenzoate ester [product of Wako Pure Chemical Industries, Ltd.]

(A3) Triphenyl phosphate (TPP) [product of Wako Pure Chemical Industries, Ltd.]

(A4) Tricresyl phosphate (TCP) [product of Wako Pure Chemical Industries, Ltd.]

(B) Lubricant Base Oil (B1) Polyol ester oil (ester of neopentyl glycol and n-nonanoic acid, 40° C. kinematic viscosity: 8.4 $mm^2/s$, viscosity index: 134, pour point: −37.5° C., flash point: 180° C.)

(B2) Polyalkylene glycol (PAG with an oxypropylene skeleton, having a butyl group and hydroxyl group at the ends, 40° C. kinematic viscosity: 56 $mm^2/s$, viscosity index: 187, pour point: −42.5° C., flash point: 220° C.)

(B3) Rapeseed oil (vegetable oil), (40° C. kinematic viscosity: 35.6 $mm^2/s$, viscosity index: 210, pour point: −27.5° C., flash point: 334° C.)

(C) Other Additives

Antioxidant: di-t-Butyl-p-cresol (DBPC)

Each of the lubricating oil compositions thus obtained in Examples 1 to 7 and Comparative Examples 1 and 2 were evaluated as ordinary lubricating oil compositions, in terms of outer appearance and lubricating performance (frictional coefficient, wear depth). The measurements and evaluations were conducted by the following methods.

[Outer Appearance]

After mixing in the mixing proportions shown in Table 1 and cooling to room temperature, the prepared composition was observed by the visual outer appearance. Cases with sedimentation or precipitation were judged as unsatisfactory, and those in which uniform liquids were obtained were judged as satisfactory.

[Wear Resistance Test]

A ball/disc type reciprocating friction tester was used to measure the wear resistance for the lubricating oil compositions of Examples 1 to 7 and Comparative Examples 1 and 2.

To further minimize oil film formation and create severe lubrication conditions, the test was initiated under conditions with a low rubbing speed (1 cm/s), a high load (2200 gf), an amplitude of 20 mm and at room temperature, with 2 hours of reciprocating abrasion. The ball and disc test pieces used were bearing carbon steel (SUJ-2). The frictional coefficient after a lapse of 2 hours and the disc wear depth after the test were measured using a stylus-type surface roughness meter.

Next, the properties as a lubricant oil for an internal combustion engine, a biodegradable lubricant oil and a hydraulic oil were evaluated using the lubricating oil compositions of Examples 1 to 7, and compared with Comparative Examples 1 and 2.

[Evaluation as Lubricant Oil for Internal Combustion Engine]

The evaluation as a lubricant oil for an internal combustion engine was conducted using a cylinder/disc type SRV friction tester with the temperature set to a high temperature of 100° C., and the disc wear scar diameter and frictional coefficient were measured.

Under conditions of load: 200N, frequency: 300 Hz, amplitude: 1.0 mm, test time: 1 hour, the disc was subjected to reciprocating wear with the cylinder, and the wear scar diameter produced on the disc was measured with a microscope. The frictional coefficient was measured with a strain meter previously provided in the friction tester.

[Evaluation as Biodegradable Lubricant Oil]

For the evaluation as a biodegradable lubricant oil, the biodegradation was measured by the low-decomposition OECD method (OECD301B), which is the approval standard for certification with "Ecomark" by the Japan Environment Association. A biodegradation of 60% or greater is required for certification as biodegradable lubricant oil.

[Evaluation as Hydraulic Oil]

The evaluation as a hydraulic oil was conducted by a high-pressure vane pump test. The test was conducted according to ASTM D2882, with circulation of 56.8 liter of oil in a pump tester, and measuring the total weight loss of the vane and cam ring after a test time of 100 hours with pressure: 140 kg/cm$^2$, pump rotational speed: 1200 rpm, inlet oil temperature: 65.5° C., as the degree of wear.

The obtained measurement results and evaluation results are shown in Tables 1 and 2.

TABLE 1

| | | Example 1 | Example 2 | Example 3 | Example 4 | Example 5 |
|---|---|---|---|---|---|---|
| Composition, mass % | Wear resistance additives | | | | | |
| | A1 | 0.01 | 0.05 | 0.05 | 0.005 | 0.05 |
| | A2 | — | — | — | — | — |
| | A3 | 1.0 | 0.5 | — | 1.0 | — |
| | A4 | — | — | 1.0 | — | 1.5 |
| | Base oils | | | | | |
| | B1 | 98.79 | 99.25 | 98.79 | — | — |
| | B2 | — | — | — | 98.795 | 98.25 |
| | B3 | — | — | — | — | — |
| | Other additives | | | | | |
| | C | 0.2 | 0.2 | 0.2 | 0.2 | 0.2 |
| Properties | Kinematic viscosity (40° C.), mm$^2$/s | 8.4 | 8.4 | 8.4 | 56.0 | 56.0 |
| | Viscosity index | 134 | 134 | 134 | 187 | 187 |
| | Pour point ° C. | −37.5 | −37.5 | −37.5 | −42.5 | −42.5 |
| Basic performance | Outer appearance | Satisfactory | Satisfactory | Satisfactory | Satisfactory | Satisfactory |
| | Wear resistance test | | | | | |
| | Frictional coefficient | 0.07 | 0.07 | 0.07 | 0.07 | 0.06 |
| | Wear depth, μm | 0.07 | 0.06 | 0.06 | 0.06 | 0.05 |
| Performance | SRV Friction test (100° C.) | | | | | |
| | Frictional coefficient | 0.08 | 0.07 | 0.07 | 0.07 | 0.07 |
| | Wear scar diameter, mm | 0.39 | 0.36 | 0.33 | 0.30 | 0.27 |
| | Decomposition, % | 70 | 72 | 71 | 32 | 32 |
| | High-pressure vane pump test, Wear, mg | 36 | 35 | 34 | 34 | 23 |

TABLE 2

| | | Example 6 | Example 7 | Comp. Ex. 1 | Comp. Ex. 2 |
|---|---|---|---|---|---|
| Composition, | Wear resistance additives | | | | |
| mass % | A1 | 0.01 | 0.1 | 0.05 | — |
| | A2 | — | — | — | — |
| | A3 | 1.5 | — | — | 1.0 |
| | A4 | — | 1.0 | — | — |

TABLE 2-continued

| | | Example 6 | Example 7 | Comp. Ex. 1 | Comp. Ex. 2 |
|---|---|---|---|---|---|
| | Base oils | | | | |
| | B1 | — | — | 99.75 | 98.8 |
| | B2 | — | — | — | — |
| | B3 | 98.29 | 98.7 | — | — |
| | Other additives | | | | |
| | C | 0.2 | 0.2 | 0.2 | 0.2 |
| Properties | Kinematic viscosity (40° C.), $mm^2/s$ | 35.6 | 35.6 | 8.4 | 8.4 |
| | Viscosity index | 210 | 210 | 134 | 134 |
| | Pour point, ° C. | −27.5 | −27.5 | −37.5 | −37.5 |
| Basic performance | Outer appearance | Satisfactory | Satisfactory | Satisfactory | Satisfactory |
| | Wear resistance test | | | | |
| | Frictional coefficient | 0.06 | 0.06 | 0.11 | 0.15 |
| | Wear depth, μm | 0.05 | 0.05 | 0.30 | 0.44 |
| Performance | SRV Friction test (100° C.) | | | | |
| | Frictional coefficient | 0.06 | 0.06 | 0.13 | 0.16 |
| | Wear scar diameter, mm | 0.29 | 0.28 | 0.51 | 0.61 |
| | Decomposition (%) | 88 | 90 | 72 | 70 |
| | High-pressure vane pump test | | | | |
| | Wear, mg | 26 | 24 | 80 | 94 |

[Preparation of Refrigerating Machine Oil Compositions]

The 3,4,5-trihydroxybenzoic acid esters, phosphoric acid esters, lubricant base oils and other additives shown below were used to prepare lubricating oil compositions for the examples and comparative examples, by blending in the mixing proportions shown in Tables 3 and 4 (where the additive amounts are % by mass based on the total mass of the composition). The properties of the base oils and of the lubricant oils of the examples and comparative examples were measured according to JIS K2283 for the viscosity and viscosity index and JIS K2269 for the pour point.

(A) Wear Resistance Additives (3,4,5-trihydroxybenzoic Acid Esters, Phosphoric Acid Esters)

(A1) Propyl (n-propyl) 3,4,5-trihydroxybenzoate ester [product of Iwate Chemical Corp.]

(A2) Octyl (n-octyl) 3,4,5-trihydroxybenzoate ester [product of Wako Pure Chemical Industries, Ltd.]

(A4) Tricresyl phosphate (TCP) [product of Wako Pure Chemical Industries, Ltd.]

(A5) Triphenyl phosphorothionate (A6) 2-Ethylhexylamine salt of dioctyl acid phosphate (B) Lubricant Base Oil (B4) Tetraester of pentaerythritol and a fatty acid mixture (50 mol % 2-ethylhexanoic acid and 50 mol % 3,5,5-trimethylhexanoic acid) (40° C. kinematic viscosity: 68 $mm^2/s$, viscosity index: 90, pour point: −40.0° C.)

(B5) Copolymer of ethylvinyl ether and isobutylvinyl ether (Ethylvinyl ether/isobutylvinyl ether=7/1 (molar ratio), number-average molecular weight: 860, carbon/oxygen molar ratio: 4.25, 40° C. kinematic viscosity: 66 $mm^2/s$, viscosity index: 85, pour point: −40.0° C.)

(C) Other Additives (C1) Antioxidant: di-t-Butyl-p-cresol (DBPC)

(C2) Acid scavenger: p-t-butylphenyl glycidyl ether

Each of the lubricating oil compositions thus obtained in Examples 8 to 16 and Comparative Examples 3 to 6 were evaluated for wear resistance as refrigerating machine oil compositions.

[Wear Resistance Test]

A friction tester employing a vane (SKH-51) as the upper test piece and a disc (FC250 HRC40) as the lower test piece was mounted inside a sealed container. After introducing 600 g of sample oil into the friction test area, the system interior was vacuum deaerated and 100 g of each refrigerant listed in the table was introduced and heated. After adjusting the temperature in the sealed container to 100° C., the load was increased to 100 kgf in a stepwise manner at a load step of 10 kgf (step time: 2 min), and an abrasion test was conducted for 60 minutes at 100 kgf. After 60 minutes of testing of each sample oil, the vane wear width and the disc wear depth were measured. The obtained results are shown in Tables 3 and 4.

TABLE 3

| | | Example 8 | Example 9 | Example 10 | Example 11 | Example 12 | Example 13 |
|---|---|---|---|---|---|---|---|
| Composition, mass % | Wear resistance additives | | | | | | |
| | A1 | 0.01 | 0.01 | 0.05 | — | — | — |
| | A2 | — | — | — | 0.005 | 0.005 | 0.01 |
| | A4 | 1.0 | — | — | 1.0 | — | — |
| | A5 | — | 1.0 | — | — | 1.0 | |
| | A6 | — | — | 0.05 | — | — | 0.05 |

TABLE 3-continued

| | | Example 8 | Example 9 | Example 10 | Example 11 | Example 12 | Example 13 |
|---|---|---|---|---|---|---|---|
| | Base oils | | | | | | |
| | B4 | 98.59 | 98.59 | 99.5 | 98.595 | 98.595 | 99.54 |
| | B5 | — | — | — | — | — | — |
| | Other additives | | | | | | |
| | C1 | 0.2 | 0.2 | 0.2 | 0.2 | 0.2 | 0.2 |
| | C2 | 0.2 | 0.2 | 0.2 | 0.2 | 0.2 | 0.2 |
| Properties | Kinematic viscosity (40° C.), $mm^2/s$ | 68 | 68 | 68 | 68 | 68 | 68 |
| | Viscosity index | 90 | 90 | 90 | 90 | 90 | 90 |
| | Pour point ° C. | −40.0 | −40.0 | −40.0 | −40.0 | −40.0 | −40.0 |
| Performance | R410A | | | | | | |
| | Vane wear width μm | 150 | 160 | 130 | 140 | 160 | 130 |
| | Disk wear depth μm | 0.4 | 0.7 | 0.3 | 0.5 | 0.8 | 0.3 |
| | HFO-1234yf | | | | | | |
| | Vane wear width μm | 160 | 170 | 130 | 150 | 150 | 140 |
| | Disk wear depth μm | 0.4 | 0.5 | 0.4 | 0.6 | 0.8 | 0.4 |

TABLE 4

| | | Example 14 | Example 15 | Example 16 | Comp. Ex. 3 | Comp. Ex. 4 | Comp. Ex. 5 | Comp. Ex. 6 |
|---|---|---|---|---|---|---|---|---|
| Composition, mass % | Wear resistance additives | | | | | | | |
| | A1 | 0.01 | 0.01 | 0.05 | 0.01 | — | 0.01 | — |
| | A2 | — | — | — | — | — | — | — |
| | A4 | 1.0 | — | — | — | 1.0 | — | 1.0 |
| | A5 | — | 1.0 | — | — | — | — | — |
| | A6 | — | — | 0.05 | — | — | — | — |
| | Base oils | | | | | | | |
| | B4 | — | — | — | 99.59 | 98.6 | — | — |
| | B5 | 98.59 | 98.59 | 99.5 | — | — | 99.59 | 98.6 |
| | Other additives | | | | | | | |
| | C1 | 0.2 | 0.2 | 0.2 | 0.2 | 0.2 | 0.2 | 0.2 |
| | C2 | 0.2 | 0.2 | 0.2 | 0.2 | 0.2 | 0.2 | 0.2 |
| Properties | Kinematic viscosity (40° C.), $mm^2/s$ | 66 | 66 | 66 | 68 | 68 | 66 | 66 |
| | Viscosity index | 85 | 85 | 85 | 90 | 90 | 85 | 85 |
| | Pour point, ° C. | −40.0 | −40.0 | −40.0 | −40.0 | −40.0 | −40.0 | −40.0 |
| Performance | R410A | | | | | | | |
| | Vane wear width, μm | 240 | 250 | 210 | 310 | 210 | 390 | 300 |
| | Disk wear depth, μm | 1.8 | 2.0 | 2.2 | 2.1 | 1.3 | 3.2 | 2.5 |
| | HFO-1234yf | | | | | | | |
| | Vane wear width, μm | 250 | 240 | 210 | 300 | 220 | 370 | 320 |
| | Disk wear depth, μm | 1.8 | 1.9 | 2.1 | 2.2 | 1.2 | 3.0 | 2.4 |

The lubricating oil compositions of Examples 1 to 7 were all uniform liquids. The frictional coefficients were stable low values of 0.06-0.07 in the friction tests for the examples. Also, the disc wear depths after the friction test were 0.05-0.07 μm, or a level with virtually no wear.

In contrast, in Comparative Example 1 in which only propyl 3,4,5-trihydroxybenzoate was added, the frictional coefficient was high and the disc wear depth was also large. Also, in Comparative Example 2 in which no 3,4,5-trihydroxybenzoic acid ester was added, the frictional coefficient was high and the disc wear depth was also much larger than in the examples.

Thus, addition of a 3,4,5-trihydroxybenzoic acid ester and a phosphoric acid compound to a lubricant base oil can vastly improve the lubricity of the lubricating oil composition.

In addition, the lubricating oil compositions of Examples 1 to 7 all exhibit excellent properties as lubricant oils for internal combustion engines and hydraulic oils, while Examples 1 to 3, 6 and 7 in particular are biodegradable.

Moreover, the refrigerating machine oil compositions of Examples 8 to 16 have excellent wear resistance under refrigerant atmospheres.

INDUSTRIAL APPLICABILITY

A lubricating oil composition of the invention exhibits properties of notably reducing wear and having a stable low frictional coefficient, and is therefore useful as a lubricant oil for sliding sections in various machines and devices, and especially a lubricant oil such as a hydraulic oil, a lubricant oil for internal combustion engines or a refrigerating machine oil, or as a biodegradable lubricant oil.

The invention claimed is:

1. An operating fluid composition for a refrigerating machine, comprising:

a refrigerant and a refrigerating machine oil, which comprises:

a lubricant base oil comprising at least one ester selected from the group consisting of aromatic esters, dibasic acid esters, polyol esters, complex esters, and carbonic acid esters;

a C2-C12 alkyl ester of 3,4,5,-trihydroxybenzoic acid at 5-500 ppm by mass, based on the total mass of the refrigerating machine oil; and a phosphorus compound selected from the group consisting of phosphoric acid esters, acidic phosphoric acid esters, thiophosphoric acid esters, acidic phosphoric acid ester amine salts, chlorinated phosphoric acid esters, and phosphorous acid esters at 0.005 to 5% by mass, based on the total mass of the refrigerating machine oil.

2. An operating fluid composition for a refrigerating machine according to claim 1, wherein the C2-C12 alkyl ester of 3,4,5,-trihydroxybenzoic acid is ethyl 3,4,5-trihydroxybenzoate or propyl 3,4,5-trihydroxybenzoate.

3. An operating fluid composition for a refrigerating machine according to claim 1, wherein the phosphorus compound is at least one compound selected from among triphenyl phosphate and tricresyl phosphate.

4. An operating fluid composition for a refrigerating machine according to claim 1, wherein the 40° C. kinematic viscosity of the lubricant base oil is 2-1000 $mm^2/s$.

5. An operating fluid composition for a refrigerating machine according to claim 1, having a biodegradation of 60% or greater as measured by the low-decomposition OECD301B method.

6. A method for preparing the operating fluid composition for a refrigerating machine according to claim 1 comprising:

mixing a refrigerant and a refrigerating machine oil, which comprises:

a lubricant base oil comprising at least one ester selected from the group consisting of aromatic esters, dibasic acid esters, polyol esters, complex esters, and carbonic acid esters;

a C2-C12 alkyl ester of 3,4,5,-trihydroxybenzoic acid at 5-500 ppm by mass based on the total mass of the refrigerating machine oil; and a phosphorus compound selected from the group consisting of phosphoric acid esters, acidic phosphoric acid esters, thiophosphoric acid esters, acidic phosphoric acid ester amine salts, chlorinated phosphoric acid esters, and phosphorous acid esters at 0.005 to 5% by mass based on the total mass of the refrigerating machine oil.

7. An operating fluid composition for a refrigerating machine according to claim 1, wherein the C2-C12 alkyl ester of 3,4,5,-trihydroxybenzoic acid is a C2-C8 alkyl ester of 3,4,5,-trihydroxybenzoic acid.

8. An operating fluid composition for a refrigerating machine according to claim 2, wherein the phosphorus compound is at least one compound selected from among triphenyl phosphate and tricresyl phosphate.

9. An operating fluid composition for a refrigerating machine according to claim 7, wherein the phosphorus compound is at least one compound selected from among triphenyl phosphate and tricresyl phosphate.

* * * * *